US010506330B2

(12) United States Patent
Schuemann

(10) Patent No.: US 10,506,330 B2
(45) Date of Patent: Dec. 10, 2019

(54) HIGH-FIDELITY ELECTRODYNAMIC LINE-SOURCE LOUDSPEAKER

(71) Applicant: Karl Schuemann, Loveland, CO (US)

(72) Inventor: Karl Schuemann, Loveland, CO (US)

( * ) Notice: Subject to any disclaimer, the term of this patent is extended or adjusted under 35 U.S.C. 154(b) by 61 days.

(21) Appl. No.: 15/722,502

(22) Filed: Oct. 2, 2017

(65) Prior Publication Data

US 2018/0167720 A1 Jun. 14, 2018

Related U.S. Application Data

(60) Provisional application No. 62/433,744, filed on Dec. 13, 2016.

(51) Int. Cl.
*H04R 1/24* (2006.01)
*H04R 7/06* (2006.01)
(Continued)

(52) U.S. Cl.
CPC ..... *H04R 1/24* (2013.01); *H04R 1/403* (2013.01); *H04R 3/12* (2013.01); *H04R 7/06* (2013.01);
(Continued)

(58) Field of Classification Search
CPC ..... H04R 3/04; H04R 1/288; H04R 1/2888; H04R 1/30; H04R 2203/12; H04R 2499/11; H04R 3/002; H04R 1/24; H04R 1/2849; H04R 1/323; H04R 1/342; H04R 2201/023; H04R 2201/403; H04R 2205/026; H04R 3/02
(Continued)

(56) References Cited

U.S. PATENT DOCUMENTS 4,229,619 A * 10/1980 Takahashi ..... H04R 3/02 330/109
4,531,608 A * 7/1985 Heinz ..... H04R 7/20 181/170
(Continued)

FOREIGN PATENT DOCUMENTS

JP 2007-28419 2/2007
JP 2010124078 6/2010

OTHER PUBLICATIONS

Audio Perfectionist Journal, No. 13 2005.
(Continued)

*Primary Examiner* — Curtis A Kuntz
*Assistant Examiner* — Julie X Dang
(74) *Attorney, Agent, or Firm* — Bycer Law, PLC; Matthew L. Bycer

(57) ABSTRACT

A loudspeaker system including a pair of elongated arrays of electrodynamic drivers, each array being composed of a plurality of drivers of the same type and size. The drivers are driven by electrical signals from an audio signal converter that receives an electrical audio signal representative of sound waves to be reproduced by the loudspeaker system and converts the electrical audio signal to a modified electrical audio signal by applying an inverse of the composite electromechanical bandpass transfer function and an inverse of the composite acoustical impedance high-pass transfer function to the electrical audio signal. The drivers may be circular drivers with a nominal size (diameter) of two to four inches.

20 Claims, 22 Drawing Sheets

(51) Int. Cl.

| | |
|---|---|
| ***H04R 1/40*** | (2006.01) |
| ***H04R 3/12*** | (2006.01) |
| ***H04R 5/02*** | (2006.01) |
| ***H04R 1/02*** | (2006.01) |

(52) U.S. Cl.
CPC ..... *H04R 1/026* (2013.01); *H04R 5/02* (2013.01); *H04R 2201/028* (2013.01)

(58) Field of Classification Search
USPC ..... 381/186, 99, 182, 103, 333, 94.3, 94.4; 181/152, 153, 156
See application file for complete search history.

(56) References Cited

U.S. PATENT DOCUMENTS

| | | | | |
|---|---|---|---|---|
| 4,771,466 | A * | 9/1988 | Modafferi | H04R 3/14 381/100 |
| 2006/0153407 | A1* | 7/2006 | Keele, Jr. | H04R 1/403 381/182 |
| 2013/0034251 | A1* | 2/2013 | Fincham | H03G 3/004 381/160 |
| 2013/0142373 | A1 | 6/2013 | Kayana | |

OTHER PUBLICATIONS

Could this be Audio's Last Frontier, Roger Skoff, The Absolute Sound, Jan. 2017, pp. 40-48.
Putting the Science Back into Loudspeakers, John Watkinson, Celtic, Jul. 2, 2014.

* cited by examiner (BASE MODULE CONTAINING PROCESSOR + STACKABLE POWERED SPEAKER MODULES)

(AMPLIFIERS + POWER SUPPLIES ARE WITHIN SPEAKER MODULE CABINETS)

(STACKABLE)

(SPEAKER MODULES ARE COMPLETELY SELF-CONTAINED)

(SINGLE-BOX)

POWERED SPEAKER MODULE
(AMPLIFIER CONTAINED WITHIN)

PS IN CARRIER

PS + AMPLIFIER CONTAINED WITHIN
SPEAKER MODULE

PROC, PS + AMP ALL WITHIN
CARRIER

PASSIVE SPEAKER MODULE (DESKTOP
VARIATION)

OR

OR

HIGH-FIDELITY ELECTRODYNAMIC LINE-SOURCE LOUDSPEAKER

CROSS-REFERENCE

This patent application claims the benefit of U.S. Provisional Patent Application No. 62/433,744, filed on Dec. 13, 2016, the entire contents of which is hereby incorporated by reference.

BACKGROUND

In considering what is meant by the phrase "High Fidelity Loudspeaker," we must first have a very clear understanding of precisely what "Fidelity" means. A good working definition, compiled from numerous dictionary entries, is:

Fidelity: The Degree of Accuracy with which Music is Recorded and Reproduced.

Some Synonyms for Accuracy include: Exactness, Precision, Correctness.

In order to understand how this definition should be applied to optimum loudspeaker design, it is essential to first understand the basic form of recorded music. Shown in FIG. 1 is a sample of images which illustrate a brief moment of a single channel of recorded music in visual form. These are "screenshots" (aka "brief moments in time") taken from a high-performance digital storage oscilloscope being fed a recorded music signal from a high-fidelity preamplifier. The horizontal (X) axis represents Time, and the vertical (Y) axis represents Amplitude. In this case, amplitude is in units of voltage, as that is the conventional basic unit of recording and playback. Note the scale of the screenshots: Time is 500 us (500 microseconds) per block, or 5 ms (0.005 seconds) for the entire screen. Each tiny division is therefore 100 us (0.0001 seconds). Amplitude is 100 mV (100 millivolts) per block, or 20 mV per tiny division.

The exact names (artists, songs, albums) of these particular images do not matter at all—these images are intended only to give an understanding of what music actually "looks like" in real time. Within the entire catalog of recorded music known to mankind, there are literally billions upon billions of such unique images. (A single standard CD alone can hold nearly a million of these screenshots.) And these screenshots are, philosophically speaking, exactly like snowflakes—they all have certain inherent properties which they all share, and yet you can look for the rest of your life and never find two which are exactly identical—every single one of them is absolutely unique.

So, based on these visual images, what are the inherent, defining properties of music itself (and therefore, high fidelity recorded music)?

1. It is Continuous. It never jumps from one value to a completely different value in zero time, but rather, it flows continuously from one value to the next over time.

2. It is Singular. At every single moment in time, it has one and only one single, specific amplitude, never more than one nor less than one. In other words: It traces a single line through time.

3. It is Complex. It is not reducible to a simple equation, and it is constantly changing shape in unpredictable ways. Another way of saying this is: Music is always transient in nature.

4. It is Unique. At every single, precise, unique instant of time, it has a single, precise, unique corresponding amplitude. This fact is at the very heart and soul of every piece of music ever played, and every piece of music ever recorded. If you change either the amplitude at a precise moment in time, or the time at which a precise amplitude occurs, the music is no longer itself, and the reproduction can no longer be considered "High Fidelity," because the fundamental unique shape of the waveform has been changed. In other words: Time and Amplitude are absolutely inseparable if the music is to remain as it was originally, or if music is to be considered "High Fidelity" when reproduced.

Next, in order to understand what capabilities are absolutely essential to a "High Fidelity" loudspeaker, and more specifically, how good each of those capabilities must be, we must first investigate the capabilities (and limitations) of the human hearing system. Any loudspeaker (or other component) which aspires to "High Fidelity" must meet at least a minimum level of performance in all of these areas, or else the human hearing system will be able to detect very easily that the "reproduced music" is fundamentally wrong compared with "real music." The following four criteria are all different, but every single one is fundamentally important to high fidelity music reproduction:

1. Frequency Response: The range of human hearing is traditionally stated as 20 Hz-20 kHz. Music can have a wider range, but most music is within these limits. (Some basic facts: The lowest frequency attained by common instruments is A0 on the standard 88-key piano, at 27.5 Hz. The lowest frequency on a standard four-string bass is E1, at 41.2 Hz. During music reproduction, most domestic (and mastering) rooms exhibit "room gain" in the deep bass, beginning around 40 Hz and increasing at lower frequencies, and thus it is advantageous to have the loudspeaker begin a very gentle rolloff at around 40 Hz, to avoid overpressure at extremely low frequencies. Finally, most adults cannot hear much above 16 kHz, regardless of what information is above that.) Thus, in the real world, we can say that the loudspeaker system should have relatively flat anechoic response from 40 Hz-20 kHz, with a very gentle rolloff below that, keeping the in-room response flat from 20 Hz-20 kHz.

2. Dynamic Range and Signal-to-Noise Ratio: These are two very similar criteria, so are discussed together. The human hearing system has a basic dynamic range of 0 dB-120 dB SPL, from the quietest detectable sound to the limit of brief exposure before physical pain or hearing damage. Typical extremely quiet rooms, with very good acoustic isolation, have a background noise level of 20 dB (below which any signal gets buried under the background noise), with typical very quiet rooms around 30 dB background noise, and typical untreated rooms around 40-50 dB background noise. Thus, we can state that we should strive for a minimum S/N ratio, in any reproduction system, of at least 100 dB (120 dB minus 20 dB), and a minimum usable dynamic range of 100 dB also (20 dB-120 dB SPL). And 120 dB for both figures would be welcome. Because most real music has a maximum in spectral energy content in the octaves on either side of 200 Hz (i.e., 100 Hz-400 Hz), this is generally where the highest output is necessary, with slightly lower requirements over the remainder of the audio band.

3. Amplitude Resolution: Under ideal laboratory conditions, the human hearing system can resolve an amplitude difference of 0.5 dB. In the real world, while playing music, a 1.5 dB difference in amplitude is somewhat difficult to resolve, even for expert listeners, while 3 dB is rather easy even for untrained listeners. Of course, these numbers represent huge increments in loudness level. A change of 3 dB is literally twice the acoustic power (or half the power), meaning a change in signal voltage level by a factor of 1.414 (the square root of 2). Even a 1.5 dB change in level represents over a 40% change in acoustic power, or nearly a 20% change in signal voltage. To think about it another way, even if we say that a good listener can distinguish 1.5 dB increments at any volume level while listening to music, there are only 80 discrete music volume levels that his/her hearing system can possibly distinguish, from softest to loudest! (120 dB divided by 1.5 dB.) In other words, the human hearing system is really quite insensitive to changes in signal amplitude. Nonetheless, the traditional standard+/−3 dB specification for frequency response in loudspeakers is quite appropriate as a basic requirement for "high fidelity" music reproduction. And +/−1.5 dB would be preferable.

4. Time Resolution: Under ideal laboratory conditions, the human hearing system can resolve time differences of less than 10 us (0.00001 seconds, or 10 microseconds). Recent scientific experiments have shown that this is true of both binaural hearing (via sound localization studies) and monaural hearing (meaning that each individual ear has the same inherent 10 us time resolution capability, as would logically be predicted). In the real world, while playing music, a 40 us time difference is somewhat difficult to resolve, even for expert listeners, while 80 us (0.00008 seconds) is rather easy even for untrained listeners. (As an easily understood example, 80 us represents an "image shift" in a stereo playback system, from dead-center to 10 degrees off-axis. This image shift will be easily noticed by even casual listeners. More attentive listeners will be able to notice image shifts from center to only 5 degrees to one side (equal to 40 us), and many listeners can do even better than this. Similar time-resolution capabilities apply to each ear individually, even if stereo image shift is not used as the test.) Thus, similar to our amplitude data above, we can state that a "high fidelity" playback system should introduce time errors of no more than 80 us in the signal, and preferably no more than 40 us. This standard should apply throughout the majority of the audible frequency spectrum, but can be relaxed significantly in the low bass and high treble, as the human hearing system becomes quite insensitive to timing at very low and very high frequencies.

Now that we have a basic understanding of human hearing capabilities, let's briefly revisit the screenshots of music in FIG. 1. If we insist on time errors no greater than 40 us, and amplitude voltage errors of no more than 20% (both the "preferable" requirements for high fidelity above), we notice that the eyes and the ears do not see (or hear) things the same at all. At the scale of these screenshots, a time error of 40 us is only 4/10 of one tiny division! This is extremely difficult for the eye to resolve. On the other hand, with a peak-to-peak voltage of 4 blocks as seen on these screenshots, a 20% change in voltage amplitude is 4 full tiny divisions of error in amplitude, 10 times more than the allowable visual error in the time scale, and incredibly easy for the eye to resolve. If we reduced the displayed amplitude to where a 20% change in peak-to-peak amplitude represented the same visual error as on the time scale, the vertical signal voltage displayed would have an amplitude of only +/−1 tiny division!! In other words, it would be so shrunken in vertical scale that the eyes would hardly be able to resolve any changes in amplitude in the signal at all. This should give a visual illustration of just how critically important time errors are, relative to amplitude errors. One should not allow their eyes to deceive them about the capabilities of their ears—they are two entirely different physiological systems, and their relative capabilities are not at all the same. The human hearing system is vastly more sensitive to Time than it is to Amplitude.

It should be emphasized once again that the above four criteria should all be met simultaneously, in order for a music playback system to present reproduced music in a form which the human hearing system will recognize as "like real music." Any system which does not meet all four criteria simultaneously should not be described as "High Fidelity," because the human hearing system's innate capabilities will easily be able to recognize that it is not.

It is now necessary to investigate the inherent capabilities and limitations of the major types of historical loudspeakers, and then to understand why those limitations fundamentally prevent them from attaining the label "High Fidelity," regardless of cost.

1. Horn Loudspeakers: The earliest form of sound reproduction device, dating to the 1800s and used by Edison in the earliest forms of sound recording and playback. Still used extensively for low-fidelity sound reinforcement applications, where output capability and efficiency are paramount. Problems include: (a) Non-linear air pressure swings during compression vs. rarefaction, resulting in audible distortions, (b) "Horn Colorations" due to suboptimal physical horn geometry, also an audible form of distortion, (c) limited bandwidth of individual horns, necessitating the use of multiple drivers with crossovers, which automatically precludes high fidelity (discussed in more detail below), and (d) Necessity of use either with dynamic woofers (with all the problems discussed below), or with bass horns which, if sized for true 20 Hz extension, are the size of entire rooms.

2. Electrodynamic or Dynamic ("direct radiator") Loudspeakers: Also rather old, with the earliest crude forms dating back to the late 1800's. The basic modern form of this type was described by Rice and Kellogg in 1925, nearly 100 years ago, and all modern iterations operate on the same fundamental physics. The fundamental limitation of the dynamic loudspeaker is that it operates (in physics terms) as a mass on a spring. This will be covered in much greater detail below. Briefly put, because it has mass, it has inertia, and because it has inertia, it is always and forever trying (unsuccessfully) to catch up to the input signal. It can't be started moving when it should, and it can't be stopped when it should either. And at every point in between, it is always behind where it should be, in the time domain. Even worse, its time lag is both transient-dependent and frequency-dependent, meaning that its time delays are not consistent across the frequency spectrum—the lower frequency components of the signal are delayed in time worse than the higher frequencies, and therefore these problems cannot be fixed by simple physical driver offsets—it is mathematically impossible. Therefore, it cannot meet the basic requirements for "High Fidelity," even as a single driver without the additional problems of crossovers, because it is a complete disaster in the time domain relative to the requirements of "High Fidelity."

3. Multiway Electrodynamic (Dynamic) Loudspeakers: A variation of the above, but with multiple drivers, each of which covers a limited frequency range, usually with crossovers dividing the signal between individual drivers. By far the most popular modern form of the loudspeaker. This type takes the fundamental Achilles' Heel of the electrodynamic driver above (the "mass on a spring" problem), and makes it even worse in the time domain. There are two main reasons for this:

3.1 Woofer diaphragms have 5-10 times the mass of midrange diaphragms, which in turn have 5-10 times the mass of tweeter diaphragms. Yet the drivers all have relatively similar magnetic field strengths. This means, based on basic physics (F=ma), that the acceleration of tweeters is vastly faster than midranges, which in turn are vastly faster than woofers. This can be seen very clearly by looking at the impulse response of a multiway loudspeaker, even many which claim to be "time aligned": First to arrive is the tweeter impulse, followed (after a delay of typically 200 us) by the midrange impulse, followed (after an even longer delay, typically 1000 us) by the woofer impulse. This is the natural consequence of a mass responding to an input force: A lot more mass takes a lot longer to get it moving. And notice the delay times: all of them are extremely obvious relative to the known real-world capability of the human hearing system at 40 us. Furthermore, we have already established that all music is transient in nature. Thus, whenever the musical signal changes direction unpredictably (which, as we already know, is all the time), the tweeter's change in response to that signal will arrive at the ears long before the midrange's, which in turn will arrive long before the woofer's.

3.2 The crossovers typically used in multiway systems contribute even more frequency-dependent non-linear phase shift, and those phase shift errors are added to the innate responses of the drivers. And this problem gets worse as the crossover slope goes higher. It is mathematical fact that no crossover type above first-order can possibly sum correctly in time and amplitude under transient conditions (aka real music). It is not merely difficult; it is mathematically impossible. And since these phase errors are again non-linear with frequency, they contribute non-linear time errors to the system's response. And again, these time errors cannot possibly be fixed with physical driver offsets, because they vary with frequency. When combined with the inherent mass-related time delays above, it is normal in multiway dynamic systems to have phase error differences in the range of 720 degrees or more across the frequency spectrum. This is a complete disaster in the time domain.

The practical consequence of this behavior, in all conventional dynamic loudspeakers, regardless of type or cost, is that for any instrument which generates fundamentals and overtones (which includes virtually any instrument one could possibly name), many overtones will arrive at the ears long before the fundamentals. Certainly a single-driver speaker is superior in this regard relative to a non-time-aligned multiway with high-order crossovers, but the fundamental problem remains. Imagine just how incredibly irritating this is to the human hearing system, to constantly be bombarded by high frequency overtones long before the arrival of the lower frequency fundamentals. This, in a nutshell, is the source of "brightness" and "glare" and "listener fatigue" in speakers which otherwise may measure "flat" in frequency response, and also the fundamental reason why dynamic speakers are instantly recognized by the human hearing system as "speakers" and "not real." It is also the reason why many dynamic loudspeakers have a deliberate pronounced "downward slope" in frequency response from bass to treble, often 10 dB or more: Their designers are trying to compensate for the irritation caused by the early arrival of the high frequencies, relative to the low frequencies, by progressively boosting the lower frequencies. This is basically a very crude attempt to try to fool the ear into paying more attention to the (late-arriving) lower frequencies, because they are louder relative to the (early-arriving) higher frequencies, thus supposedly "balancing out" the perceived sound. But this does not work because it is impossible to fix an inherent problem in the time domain by creating an equally egregious problem in the amplitude domain.

In conventional dynamic loudspeakers, given the magnitude of the time delays between various frequency components in the music, even from a single dynamic driver, it is obvious to the ears that something is very, very wrong. But because this type of (time arrival) error occurs nowhere in nature and nowhere in natural sounds, humans have never adapted to it evolutionarily, and the ear can't recognize what the problem is, although it knows for sure that something is very wrong. It knows that there is a very big difference between what it's hearing, and what real natural music sounds like.

4. Panel Dipole (Electrostatic or similar) Loudspeakers: First seen 60 years ago in Peter Walker's legendary Quad in 1957. Historically speaking, the last big breakthrough in loudspeaker performance, and the first wide-range transducer in the history of the world to have, at least approximately, correct Time vs. Amplitude characteristics. (And also the reason that it actually sounds like real music in the upper half of the human hearing range.) However, the electrostat (or any planar dipole variation) cannot be considered "high fidelity" due to the fact that it is a dipole. Because it is a dipole, it creates a full-power inverted-phase acoustical backwave at exactly the same time as the front wave. And at frequencies beginning in the midrange and steadily worsening at lower frequencies, the inverted-phase backwave becomes progressively less directional, and begins to combine with the front wave, but with a large time delay. This results in enormous errors in both time and amplitude, with the result being that dipoles, by definition, cannot be considered "high fidelity" loudspeakers. Furthermore, the limited excursion available in all electrostats creates power-handling problems in the bass which, added to dipolar bass cancellation, seriously compromises amplitude accuracy and dynamic range at lower frequencies. Many speakers have tried to mate dynamic woofers to electrostats with crossovers, but they all suffer from the same (unsolvable) problems in the time domain as multiway dynamics.

5. Bending-Wave Loudspeakers: These fall into both flexible-diaphragm and semi-rigid-diaphragm types, with many variations. However, all of them suffer from the same problems: (a) Presence of flexure and mechanical standing waves on diaphragms, resulting in significant errors in both time and amplitude, and (b) limited bandwidth, typically resulting in the necessity (yet again) of combining them with dynamic woofers and crossovers, again precluding high fidelity.

It is against this background that the present invention has been developed.

SUMMARY

Disclosed herein is an electrodynamic line-source loudspeaker system that includes: an elongated array of electrodynamic drivers that receive an electrical signal and convert the electrical energy in the electrical signal into movement of a diaphragm, wherein the elongated array has a long axis and a short axis that is orthogonal to the long axis, the long axis having a significantly greater length than the short axis, wherein each driver in the array is of the same size, wherein the array has a composite electromechanical bandpass transfer function and the array has a composite acoustical impedance high-pass transfer function; an audio signal converter, wherein the audio signal converter receives an electrical audio signal representative of sound waves to be reproduced by the loudspeaker system and the audio signal converter converts the electrical audio signal to a modified electrical audio signal by applying an inverse of the electromechanical bandpass transfer function and applying an inverse of the acoustical impedance high-pass transfer function to the electrical audio signal. The modified electrical audio signal is the electrical signal received by the elongated array of electrodynamic drivers.

Each of the drivers in the array may be operated in acoustic parallel such that the acoustic output of the drivers is additive. Each driver may have a first mechanical diaphragm resonance above 10 kHz, above 15 kHz, or above 20 kHz. The array may be configured for placement in a corner of a room with the long axis oriented vertically. The array may extend for at least 75% of a distance between a floor and a ceiling of the room. The system may further include a second such audio signal converter and a second such elongated array of electrodynamic drivers, and wherein the second array may be configured for placement in a second corner of the room with the long axis oriented vertically.

The array of drivers may be mounted in a single enclosure. The array of drivers may be mounted in a plurality of enclosures. Each enclosure may include a plurality of drivers. There may be an audio signal converter for each enclosure. A portion of the drivers in each enclosure may be electrically connected together in series. Two or more of the drivers in each enclosure may be electrically connected together in series to form a first set of drivers in each enclosure, two or more other drivers in each enclosure are electrically connected together in series to form a second set of drivers in each enclosure, and the two sets of drivers in each enclosure are electrically connected together in parallel. Two or more drivers in each enclosure may be electrically connected together in parallel. Each enclosure may have mating surfaces defined on a top surface thereof and mating surfaces defined on a bottom surface thereof, the mating surfaces on the top surface of one of the plurality of enclosures being engageable with the mating surfaces on the bottom surface of another one of the plurality of enclosures, wherein the plurality of enclosures can be engaged with each other to form an elongated stack of enclosures to achieve the elongated array of electrodynamic drivers. At least three such enclosures may be engaged with each other to form the elongated stack.

The elongated array of electrodynamic drivers may include only a single elongated electrodynamic driver. The elongated array of electrodynamic drivers may include at least 10 electrodynamic drivers of the same type and size. The elongated array of electrodynamic drivers may include at least 20 electrodynamic drivers of the same type and size. The elongated array of electrodynamic drivers may include a plurality of circularly-shaped electrodynamic drivers of the same type and size.

Also disclosed is an electrodynamic line-source loudspeaker system that includes: an elongated array of electrodynamic drivers that receive an electrical signal and convert the electrical energy in the electrical signal into movement of a diaphragm, wherein the elongated array has a long axis and a short axis that is orthogonal to the long axis, the long axis having a significantly greater length than the short axis, wherein each driver in the array is of the same size, wherein the array has a composite electromechanical bandpass transfer function and the array has a composite acoustical impedance high-pass transfer function, wherein each driver is a circularly-shaped electrodynamic drivers of the same type and size and each driver has a first mechanical diaphragm resonance above 10 kHz, wherein the array includes at least 10 such drivers; and an audio signal converter, wherein the audio signal converter receives an electrical audio signal representative of sound waves to be reproduced by the loudspeaker system and the audio signal converter converts the electrical audio signal to a modified electrical audio signal by applying an inverse of the electromechanical bandpass transfer function and applying an inverse of the acoustical impedance high-pass transfer function to the electrical audio signal. The modified electrical audio signal is the electrical signal received by the array of electrodynamic drivers. The array is configured for placement in a corner of a room with the long axis oriented vertically and the array extends for at least 75% of a distance between a floor and a ceiling of the room.

Each of the drivers in the array may be operated in acoustic parallel such that the acoustic output of the drivers is additive. Each driver may have a first mechanical diaphragm resonance above 10 kHz. The system may further include a second such audio signal converter and a second such elongated array of electrodynamic drivers, and wherein the second array is configured for placement in a second corner of the room with the long axis oriented vertically. The array of drivers may be mounted in a single enclosure. The array of drivers may be mounted in a plurality of enclosures. Each enclosure may include a plurality of drivers. There may be an audio signal converter for each enclosure. A portion of the drivers in each enclosure may be electrically connected together in series. Two or more of the drivers in each enclosure may be electrically connected together in series to form a first set of drivers in each enclosure, two or more other drivers in each enclosure may be electrically connected together in series to form a second set of drivers in each enclosure, and the two sets of drivers in each enclosure may be electrically connected together in parallel. Two or more drivers in each enclosure may be electrically connected together in parallel. Each enclosure may have mating surfaces defined on a top surface thereof and mating surfaces defined on a bottom surface thereof, the mating surfaces on the top surface of one of the plurality of enclosures being engageable with the mating surfaces on the bottom surface of another one of the plurality of enclosures, wherein the plurality of enclosures may be engaged with each other to form an elongated stack of enclosures to achieve the elongated array of electrodynamic drivers. At least three such enclosures may be engaged with each other to form the elongated stack.

The elongated array of electrodynamic drivers may include only a single elongated electrodynamic driver. The elongated array of electrodynamic drivers may include at least 10 electrodynamic drivers of the same type and size.

DETAILED DESCRIPTION

Figure 1:
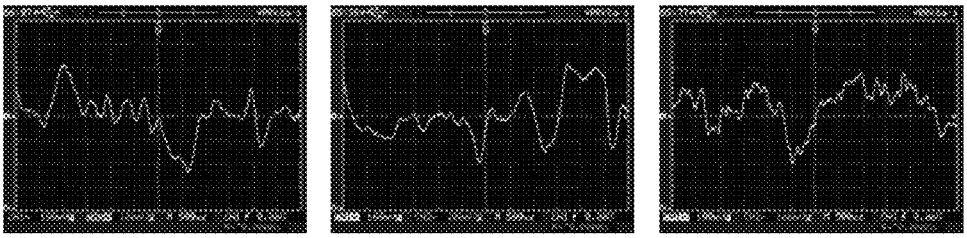
FIG. 1 shows screenshots of three different short sections of recorded music in visual form.

While the disclosure is susceptible to various modifications and alternative forms, specific embodiments thereof have been shown by way of example in the drawings and are herein described in detail. It should be understood, however, that it is not intended to limit the disclosure to the particular form disclosed, but rather, the disclosure is to cover all modifications, equivalents, and alternatives falling within the scope as defined by the claims.

If we were to attempt to design an "ideal" High-Fidelity loudspeaker, what would we expect of it? Following are 7 criteria, all of which would be met simultaneously by our ideal loudspeaker:

1. First, and by far the most important: It must be fundamentally correct in its Time vs. Amplitude acoustical output, across the entire frequency spectrum of human hearing. In the real world, this means that it must have no apparent inertia, i.e., if it has mass, it must include a way of precisely negating the time delays associated with forcing that mass to change its velocity in real time.

2. As a corollary to (1), it must have essentially full-range flat frequency response in-room. Please Note: Any system which has fundamentally correct Time vs. Amplitude response to signals within the normal audio range will automatically (by mathematical definition) have flat frequency response within that range. It is critically important to understand this fact, so if necessary, please read that sentence again.

3. It must have a dynamic range and S/N ratio of at least 100 dB, and preferably as much as 120 dB, preferably throughout the audio range but at least above 100 Hz, which is the lower end of the "power range" of most real music.

4. It must not contain multiple drivers of different types, or crossovers of any kind. Such designs are automatically disqualified from the definition of "High Fidelity," as detailed above. This means that all drivers used must be fundamentally capable of full-frequency-range performance, and must be of the same exact type.

5. Any driver diaphragm(s) must not undergo mechanical flexure or standing waves within the normal audio frequency range (20 Hz-20 kHz), i.e., diaphragms must behave as rigid (pistonic) surfaces throughout the entire audio frequency range.

6. It should create a spatially uniform acoustic wavefront in-room without significant lobing, wave interference effects, phase cancellations, etc. Only two fundamental wave radiation patterns qualify under this requirement: Spherical (point source) or Cylindrical (line source). This essentially precludes the use of spaced multiway systems or large-diameter diaphragms of any type.

7. It should be capable of being installed in normal rooms, and of avoiding strong early reflections from room boundaries, with only the use of standard, easily installed room acoustic treatments. This essentially precludes any system design which could have a "floor bounce" interfere with its acoustic output, as floors are extremely impractical to treat acoustically.

Armed with the above 7 objectives for "High Fidelity" loudspeaker design, we are now finally ready to begin to discuss the design of the loudspeaker reference system disclosed herein.

The Time Vs. Amplitude Problem

Since this is not only the most important of the 7 criteria above, but also the design aspect most likely to be deemed "impossible to solve" by many in the field, we will first present the results of solving this problem, and then we will proceed to the "how" it was solved.

Figure 2:
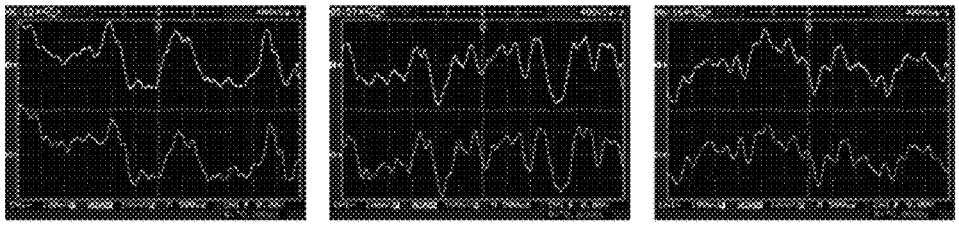
FIG. 2 shows the comparison of screenshots of three different short sections of recorded music with screenshots of three different sections of music as reproduced by the loudspeaker system disclosed herein.

FIG. 2 provides a new set of screenshots, again taken from the same high-performance digital storage oscilloscope. The musical selections again do not matter, as the same basic results will be obtained no matter which particular piece of music is fed through the system. But in these screenshots, instead of a single trace, there are now two traces, an upper trace and a lower trace. As before, the upper trace is simply the output of a high-fidelity playback preamplifier; in other words, it is a "High Fidelity" form of the original recorded musical signal, taken at the exact same time as the exact same signal is fed to the input of the loudspeaker system disclosed herein and described in detail below. The lower trace is simply the final acoustic output of the loudspeaker system, as picked up by a high-quality condenser (aka monopolar electrostatic) measurement microphone, amplified by a high-quality microphone preamplifier, and then fed directly back to the oscilloscope in real time.

Note that the acoustic output of the loudspeaker system bears a shocking resemblance to the original musical input signal, in both Time and Amplitude, but most critically, in Time. (If you look carefully, you will see a very slight but very consistent time delay between the upper and lower traces (approximately one tiny division), which is the result of the very small but still noticeable sound-wave travel time between the driver voice coil and the microphone capsule.) These results should be absolutely eye-popping and jaw-dropping to anyone who understands just how poorly traditional loudspeakers perform on this test, regardless of price. This is not only the very essence of "High Fidelity" music reproduction, it is also the very first time in the entire history of the world that a loudspeaker has actually achieved this breakthrough in a design which meets all of the above 7 criteria.

Physics and Mathematics

Upon seeing these results, the obvious question is: "Since the loudspeaker reference system is clearly using dynamic drivers, how can it possibly behave as if those drivers are essentially massless, as it is clearly doing?" To answer this question, it is necessary to discuss some basic physics and mathematics.

To begin, let's think about the physics of the dynamic driver. Fundamentally, as a mechanical system, it is a "mass on a spring with damping." This is a basic physics problem seen in every college physics (and in mathematics, differential equations) curriculum. And it is the reason why the Time vs. Amplitude response of every conventional dynamic driver is absolutely terrible, regardless of cost. Due to the time delays created by the inertia inherent in the mass, the conventional dynamic driver simply cannot follow the input signal in real time. Even worse, these time delays are not constant with frequency, nor constant under transient input conditions. "High Fidelity" is simply impossible in these circumstances.

Next, it is necessary to introduce the concept of the "transfer function." Simply defined, a "transfer function" is a mathematical equation which describes the behavior (or output) of a system based on some input variable(s). So, in the case of a "mass on a spring with damping," there is a specific differential equation (or "transfer function") describing the motion of that system in response to some input. In this case, the "input" is an audio signal in the form of a varying voltage, with the properties discussed above. In a dynamic driver, that varying voltage causes a varying current to flow through the voice coil, which, being immersed in a magnetic field, generates a force proportional to that current. That force, in turn, acts on the "mass on a spring with damping," creating a varying acceleration according to F=ma, which in turn creates a varying velocity of the cone, and thus an acoustic output (sound) by transference of that velocity into the air molecules which are in contact with the cone. The differential equations which describe this system's transfer functions are provided below. Of course, they are extremely non-linear functions, in both Time and Amplitude, which explains why the fidelity of conventional dynamic drivers is so poor.

$$I(t) = \frac{d^2V}{dt^2} + \left(\frac{1}{RC}\right)\left(\frac{dV}{dt}\right) + \frac{1}{LC}V \tag{1}$$

$$V(t) = R\frac{dQ(t)}{dt} + \frac{1}{C}Q(t), \quad \text{where } \frac{dQ(t)}{dt} = I(t) \tag{2}$$

To sum up, the conventional dynamic driver transforms electrical energy (voltage and current) into mechanical energy (alternating kinetic and potential energy in the "mass on a spring" system), resulting in a delayed and non-linear mechanical response to the electrical signal, and that mechanical energy is then transformed into acoustical energy, resulting in a "low fidelity" form of the original input signal.

It turns out that the mathematical differential equations which describe the transfer function of the "mass on a spring with damping" mechanical system are absolutely identical to the mathematical differential equations which describe the transfer function of an LCR (Inductor, Capacitor, Resistor) electrical system.

Of course, if you multiply a mathematical function (any mathematical function) by its inverse, you get unity. Simply put, if you multiply "f" times "1/f", you get the answer "1". (And it obviously doesn't matter what "f" is; you always get the answer "1".) And that means that, for any transfer function multiplied by its inverse, by mathematical definition, input equals output, in both Time and Amplitude.

The following are some definitions for an electrodynamic loudspeaker driver:

A electrodynamic driver or electrodynamic loudspeaker driver is a device comprised of one or more structure(s) containing:

a magnetic field;

a voice coil containing electrically conductive wire immersed within said magnetic field, said voice coil being designed to undergo linear motion, along the axis of the voice coil, in response to electrical current being passed through said wire of said voice coil;

a diaphragm attached to said voice coil in a geometric plane perpendicular to said axis of linear motion of said voice coil, the exterior surface of said diaphragm being in contact with atmospheric air, the purpose of said diaphragm being to translate mechanical voice coil linear motion into acoustic pressure waves within said atmospheric air; and a mechanical suspension system attached to said voice coil and/or said diaphragm, the purpose of said suspension system being to restrict spatial motion of said diaphragm and voice coil to only along said axis of linear motion.

An enclosure may contain one or more said electrodynamic drivers, wherein the exterior surface of said diaphragm(s) is in contact with atmospheric air, said enclosure having a substantially sealed interior cavity designed to contain and absorb the acoustic waves created by the interior surface(s) of said diaphragm(s) which contact the air within said interior cavity.

A more simplified definition is a device containing a magnetic field and a means of passing electrical current through said magnetic field, resulting in a force being exerted in a vector direction orthogonal to the vector directions of both said magnetic field and said current, according to the Lorentz Force Law, said force being mechanically coupled to a moveable diaphragm having mass and surface area, said diaphragm being in contact with atmospheric air, the movement of said diaphragm in a direction orthogonal to its surface area causing the creation of pressure waves (aka sound) within said atmospheric air.

Figure 3:
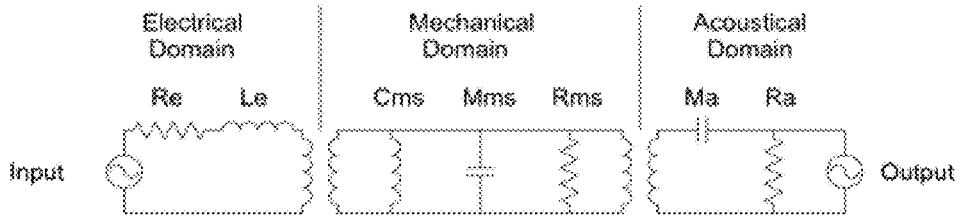
FIG. 3 shows a schematic model of a modern electrodynamic loudspeaker driver.

The "full basic model" of the modern electrodynamic loudspeaker driver, as shown in many basic acoustics textbooks, is provided in FIG. 3. First of all, there are 3 main sections (or "domains") seen in the model: On the left is the Electrical Domain. In the middle is the Mechanical Domain. And on the right is the Acoustical Domain. These 3 domains are separated by 2 transformations. It is inaccurate to call them "transformers," although visually models such as this use the electrical symbol of a transformer. The symbols actually represent the "transformation" of energy from one form to another—first, from electrical to mechanical energy, and second, from mechanical to acoustical energy.

Figure 4:
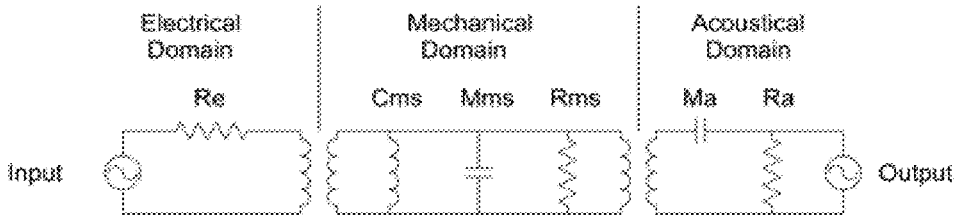
FIG. 4 shows a simplified schematic model of a modern electrodynamic loudspeaker driver.

Beginning with the Electrical Domain, we see a signal "input source" denoted by a circle with a wave in it. This would normally be an amplifier in the real world. Next, we see a resistor and an inductor in series, which represents the electrical resistance and inductance of the driver's voice coil (and wiring, etc.). In larger drivers, the inductance of the voice coil is often high enough that it forms an electrical low-pass filter which attenuates high frequencies. However, in small drivers with small voice coils, such as those used in the loudspeaker reference system disclosed herein, the effect of the inductance within the audio range is negligible, and can therefore be ignored. The basic model can therefore be simplified to that shown in FIG. 4.

With the Electrical Domain now consisting of only a source and a resistor, its transfer function is extremely simple and completely linear in both time and amplitude: Current is directly proportional to Voltage. This part of the system needs no further attention.

Figure 5:
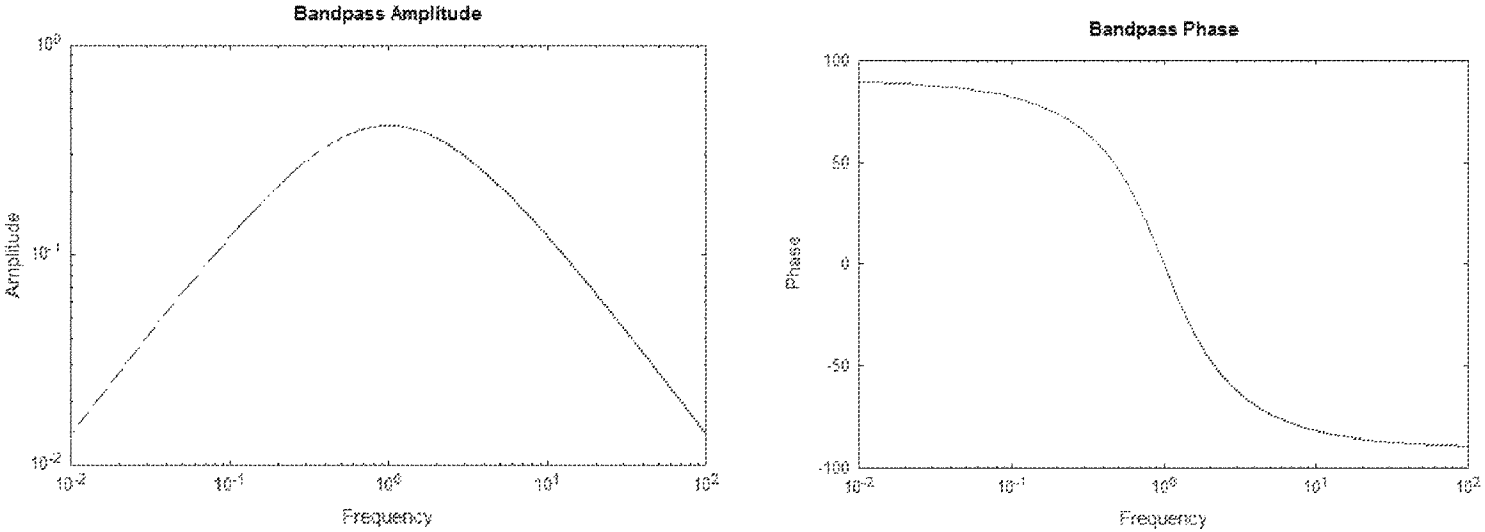
FIG. 5 shows in graphical form the transfer function of a second order band-pass filter that represents the composite electromechanical transfer function of a loudspeaker driver.

Moving to the Mechanical Domain, we see the LCR representation (or "Analogy") of the "mass on a spring with damping" mechanical system. To repeat, the LCR form is mathematically identical to the "mass on a spring with damping" mechanical form, so it is shown visually in LCR electrical form here. The transfer function of this LCR circuit is commonly known as a "second order band-pass filter," with the center (resonant) frequency of the band-pass filter being the mechanical resonant frequency of the driver system (in the enclosure), and the Q of the band-pass filter equal to the total Q of the driver system (in the enclosure). Note that the term "second order band-pass filter" defines a function with a first-order downward slope on either side of the center (resonant) frequency, thus the name "second order"—there is no such thing as a "first order band-pass filter." The effective Amplitude vs. Frequency and Phase vs. Frequency plots of the "second order band-pass filter" transfer function are shown in FIG. 5.

Figure 6:
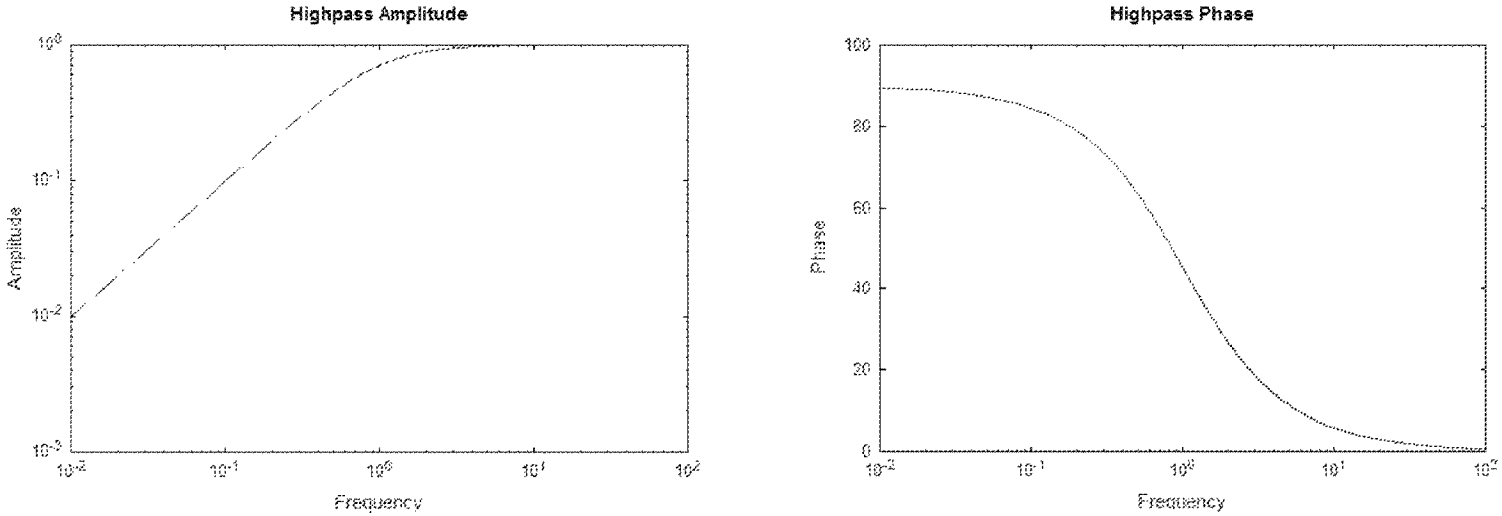
FIG. 6 shows in graphical form the transfer function of a first order high-pass filter that represents the composite acoustical impedance transfer function of a loudspeaker driver.

Moving to the Acoustical Domain, we see a capacitor in series with a resistor, with the acoustical output taken across the resistor. Again, similar to the Mechanical Domain, this is the electrical analogy of the acoustical transfer function (or more specifically, the air's "acoustic impedance" function)—obviously, air is not actually made from physical capacitors and resistors in the real world. But similar to the Mechanical Domain's analogy, the air's acoustic impedance function can be represented by an electrical RC circuit here, because the mathematical differential equations are the same. Fundamentally, the air functions as a "first order high-pass filter", wherein its ability to transform mechanical diaphragm motion into acoustical energy remains essentially constant at high frequencies, then as frequencies go below a certain value (approximately where the driver's circumference equals the wavelength), its efficiency in transforming mechanical energy into acoustical energy falls off steadily with decreasing frequency. The effective Amplitude vs. Frequency and Phase vs. Frequency plots of the "first order high-pass filter" transfer function are shown in FIG. 6.

Now, the basic operating principle of the traditional dynamic driver is this: The falling slope of the LCR transfer function cancels the (opposing) rising slope of the RC transfer function in the Amplitude vs. Frequency domain, resulting in flat acoustical power output between (1) the driver's resonant frequency and (2) the point at which the driver's circumference is approximately equal to the wavelength. This is typically a decade (3 octaves) or so, in terms of frequency response. However, since the two transfer functions (mechanical LCR and acoustical RC) are NOT mathematical inverses of one another, the phase response (and thus, the Time vs. Amplitude performance) of the total system is badly damaged. This is the heart of the problem with conventional dynamic drivers, and up to now, it has been considered essentially "impossible to solve," because all drivers have mass and therefore inertia.

However, there is a way of solving this problem by thinking completely "outside the box" and solving the problem at its very source. And it is this: If we apply the exact inverse transfer function of the (Mechanical) LCR circuit, in series with the exact actual transfer function of the LCR circuit, we instantly convert both its Amplitude and Phase responses to unity (as stated above, "f" times "1/f" equals unity, regardless of the definition of "f"). And furthermore, if we apply the exact inverse transfer function of the (acoustical) RC circuit in series with the exact actual transfer function of the RC circuit, we instantly convert both its Amplitude and Phase responses to unity once again. Both inverse transfer functions can be applied in the (real-world) electrical domain, before the signal ever reaches the loudspeaker (and, being in the electrical domain, will take effect at very nearly the speed of light, vastly faster than is needed to correct problems in the audio frequency range). But because the transfer functions and inverse transfer functions are all in series (in terms of the combined system), their effects are all combined (or "cascaded"), with the result that the final acoustical output of the loudspeaker reference system is now virtually identical to the original electrical input from the preamplifier, in real time. The Time vs. Amplitude problem has been solved in the purest and cleanest possible way.

Figure 7:
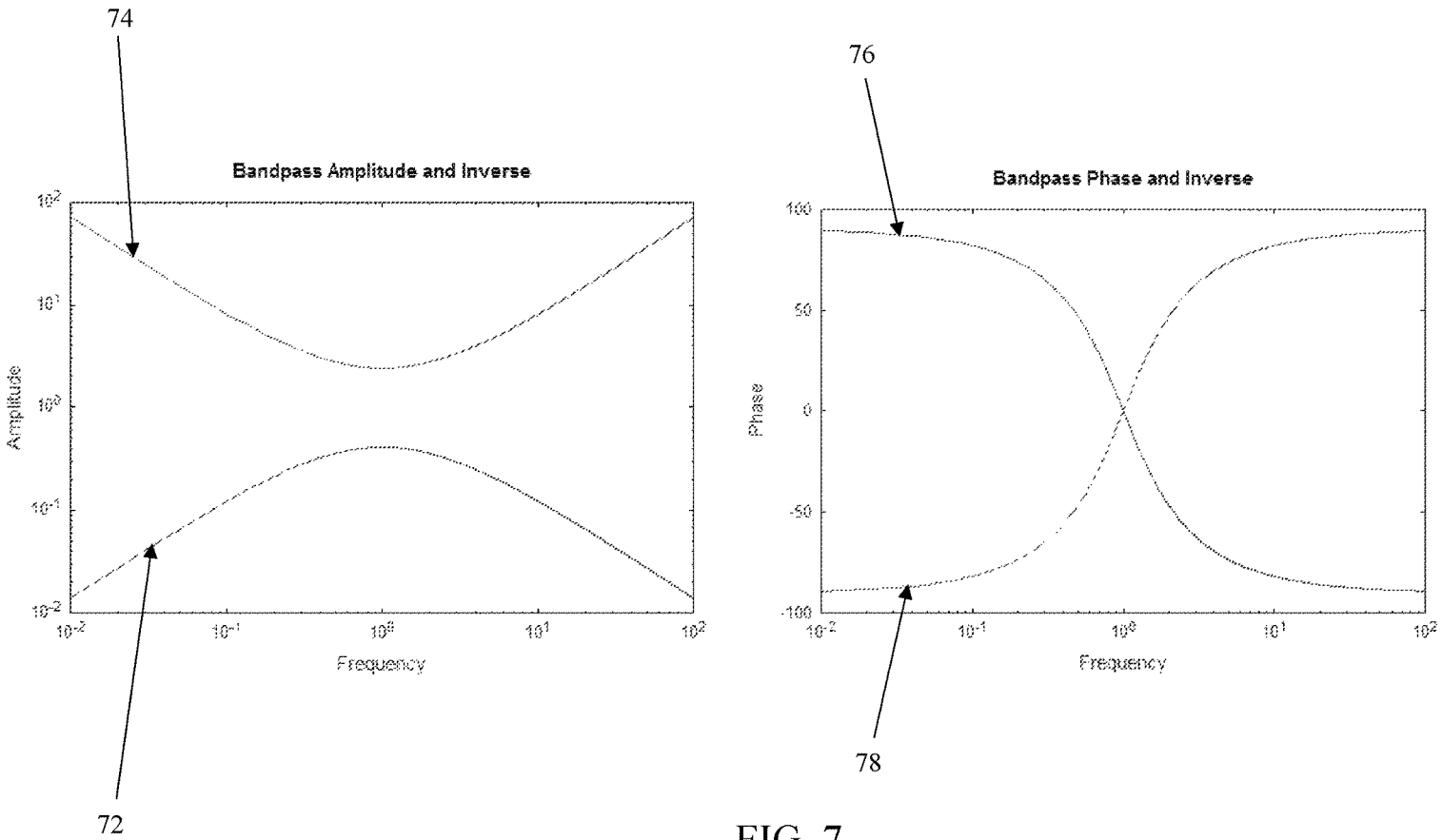
FIG. 7 shows the transfer function of FIG. 5 plotted along with its mathematical inverse.
Figure 8:
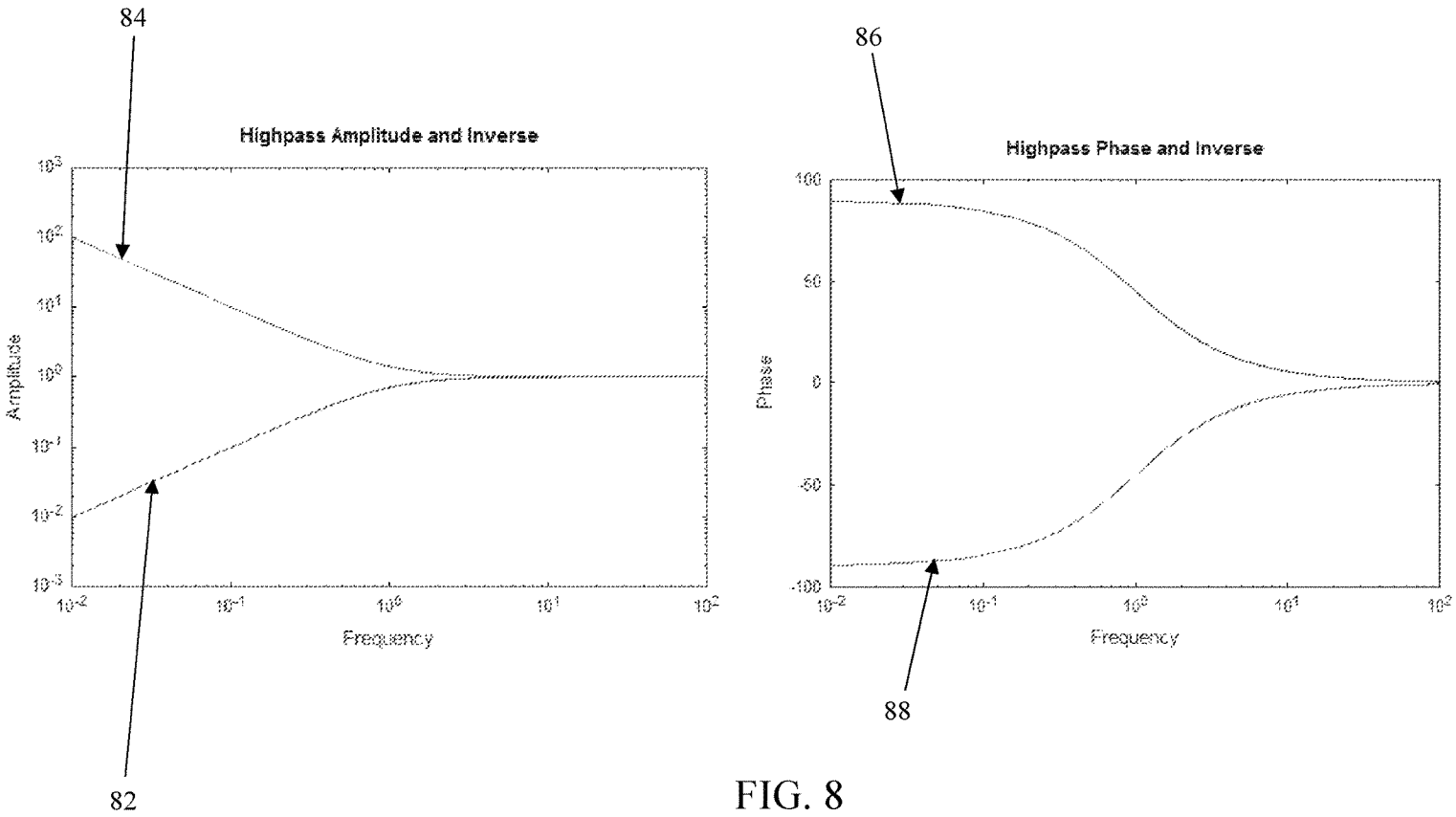
FIG. 8 shows the transfer function of FIG. 6 plotted along with its mathematical inverse.

This is shown graphically in FIGS. 7 and 8, where the original transfer functions (72 and 76 in FIGS. 7 and 82 and 86 in FIG. 8) and their mathematical inverses (74 and 78 in FIGS. 7 and 84 and 88 in FIG. 8) are labelled. Note that at any frequency, multiplying the two amplitudes (original and mathematical inverse) results in unity amplitude, and adding the two phase shifts results in zero phase shift. This is, both mathematically and in the real world, unity: There is no significant change in the original, unique form of the music signal, when comparing electrical input and acoustical output in real time.

By taking this approach, we have eliminated every inherent deviation from pure linearity in the entire "basic model" of the dynamic driver, in both Time and Amplitude. If we look at the entire composite (cascaded) transfer function of the complete loudspeaker reference system, it becomes essentially a straight wire with gain, to use the common phrase. Perhaps even more shocking (at least until you understand the physics and mathematics): The drivers now behave (in the real world!) as if they are essentially massless. Or, to put it more generally: Input equals Output, in both Time and Amplitude, with the acoustical output now being essentially identical to the electrical input in real time. And that is the core operating principle of the loudspeaker reference system, and that is why it is so utterly revolutionary.

Practical Considerations for the loudspeaker reference system disclosed herein in the Real World While the basic operating principle of the loudspeaker reference system disclosed herein is a revolutionary breakthrough, its real-world form is a carefully balanced optimization of many competing factors. These factors include, among many others:

1. Full frequency range without the use of different driver types or any crossovers.
2. Adequate Dynamic Range and S/N ratio.
3. Absence of diaphragm flexure or breakup in the audible range.
4. Idealized acoustic radiation pattern.
5. Real-world room installation and performance optimization.
6. Reasonable manufacturing and installation difficulty.
7. Reasonable cost.

In the end, there is only one "best answer" to optimize all the competing factors simultaneously, and that is the final form of the loudspeaker reference system. First of all, for several reasons, the system must be made up of a large number of small identical drivers, all operating in acoustical parallel. This is the only way to achieve an idealized radiation pattern while simultaneously achieving sufficient dynamic range and high fidelity in a full-frequency-range system. Once this reality is accepted, then the only two possible idealized physical configurations are spherical (simulated point source) or line-array (simulated line source). And the enormous problem with spherical is that when it is placed in a room, because it is essentially omnidirectional, it has enormous problems with strong early reflections off all nearby room surfaces—floors, walls, and ceilings. And when one is interested in true "High Fidelity," strong early reflections are a very bad thing. Thus, spherical is a challenging solution in the real world. Similarly, a freestanding line array of small drivers, if placed a small distance from a single wall (and acoustically speaking, a "small distance" is anything under 10 feet, or 3 meters, to any nearby surface), again has enormous problems with strong early wall reflections and standing waves. Thus, a freestanding line array is also a really challenging solution in the real world. The only choice left (and by far the best choice in the real world) is to place the line sources at the intersection of room surfaces, thus eliminating the early reflection issue altogether. This approach has proven to have vastly higher performance and realism, in every way that matters, than the historical (and now obsolete) "speakers sitting on the floor partway out into the room" approach, because it essentially eliminates all strong early reflections from the room acoustics, allowing the original acoustic venue to seemingly transport itself into the listening room.

The full-height corner line array disclosed herein also has several additional benefits:

1. When installed from room boundary to room boundary as designed (normally from floor to ceiling), it launches an essentially ideal cylindrical wavefront into the room, without any significant acoustic interactions with either floor or ceiling, and also without any significant issues from lobing or comb filtering. Thus, to achieve extremely high performance in-room with a standard 2-channel stereo installation, it is only necessary to treat the two side walls, two rear vertical corners, and rear wall of the room with basic acoustical treatments (preferably a mixture of standard acoustic absorbers, diffusers, and bass traps). And vertical walls and corners are very easy to treat, relative to floors and ceilings.

2. Because a tall line array can be assembled from multiple small identical line array "modules" without any compromises whatsoever in fidelity, it is possible to achieve a practically ideal full-height floor-to-ceiling line array installation in a room of any height, while still meeting practical concerns in manufacturing, shipping, and installation.

3. In addition, having multiple small identical line array modules makes the requisite total power amplifier output easily "distributable" among multiple smaller (and higher quality) individual amplifier sections, achieving higher fidelity than would otherwise be possible with more powerful amplifiers.

4. Because the boundary-to-boundary corner installation constrains the acoustic wave on 4 sides (left, right, top, and bottom) and forces it to remain essentially purely quarter-cylindrical as it propagates into the room, the acoustic efficiency of the system is greatly enhanced compared to the hemispherical (or, at lower frequencies, essentially omnidirectional) radiation pattern seen in typical historical loudspeaker designs. This greatly improved acoustical room coupling results in enormous gains in both linearity and dynamic range, as driver excursion for a given loudness level is greatly reduced.

5. The ubiquitous "baffle step problem" (the transition from omnidirectional to hemispherical radiation patterns due to the speaker baffle), which causes large (and again unsolvable) disparities between on-axis frequency response and in-room power response in virtually all conventional "box" speakers, again leading to unnatural sound, is essentially eliminated outright by the inherent superiority of the full-spectrum uniform cylindrical wavefront of the loudspeaker reference system.

6. Because of the extremely high uniformity and purity of the in-room cylindrical wavefront, and the almost total lack of destructive interaction with either floor or ceiling, the sound remains the same at any height in the room, from the floor to the ceiling and everywhere in between.

7. Lastly, the almost total lack of early room reflections yields an almost unbelievable increase in the clarity, purity, and intelligibility of both the original music and also the original acoustic venue. The wall between the speakers essentially "disappears" acoustically, leaving behind only the original music and acoustic space. The increase in "naturalness" due to this effect cannot be overstated, and is simply a revelation to those accustomed to traditional loudspeaker designs and traditional room placements.

Synthesis and Practical Forms of Transfer Functions and Inverse Transfer Functions of Electrodynamic Drivers Background: The "Basic Model" of the electrodynamic loudspeaker driver can be simplified to two cascaded filter functions: (1) The "Mechanical" transfer function can be represented as a "second order band-pass filter", or in other words, an LCR electrical filter, and (2) The "acoustical" transfer function can be represented as a "first order high-pass filter", or in other words, an RC electrical filter.

1. Mechanical Transfer Function and Inverse Transfer Function

The "Mechanical" LCR Transfer Function can be fully described mathematically based on only two parameters: Resonant Frequency (f), and Quality Factor (Q), where Q is defined as the inverse of the band-pass filter's bandwidth. Both f and Q can be obtained by measuring the complete loudspeaker with a standard MLS (or similar) computer-based loudspeaker measurement package, where typically they are denoted as fs and Qts. The LCR parameters can then be easily obtained from the following equations:

$$2\pi f = \sqrt{\frac{1}{LC}} \tag{3}$$

$$Q = R\sqrt{\frac{C}{L}} \tag{4}$$

Figure 9:
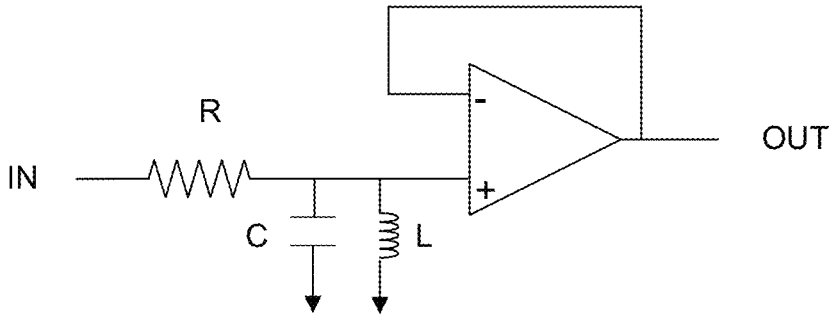
FIG. 9 shows in practical form the LCR transfer function of FIG. 5.

A practical form of the LCR transfer function, utilizing standard analog operational amplifiers (op-amps), is shown in FIG. 9.

Figure 10:
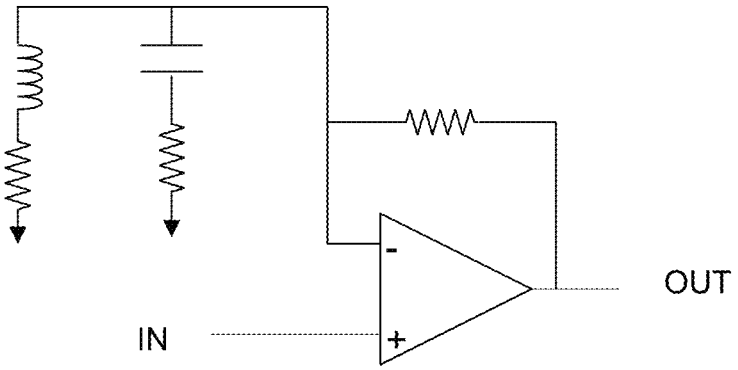
FIG. 10 shows in practical form the inverse transfer function of the LCR transfer function of FIG. 5.

The LCR Inverse Transfer Function can then easily be synthesized by placing this basic circuit in the negative feedback loop of an op-amp. Because such a circuit would approach infinite gain at very low and very high frequencies, the gain is deliberately "shelved" at the edges of the audible frequency range. This shelving is accomplished by the addition of resistors to the L and C reactive elements in the circuit. The basic practical form of the LCR Inverse Transfer Function, again utilizing analog op-amps, is shown in FIG. 10.

Figure 11:
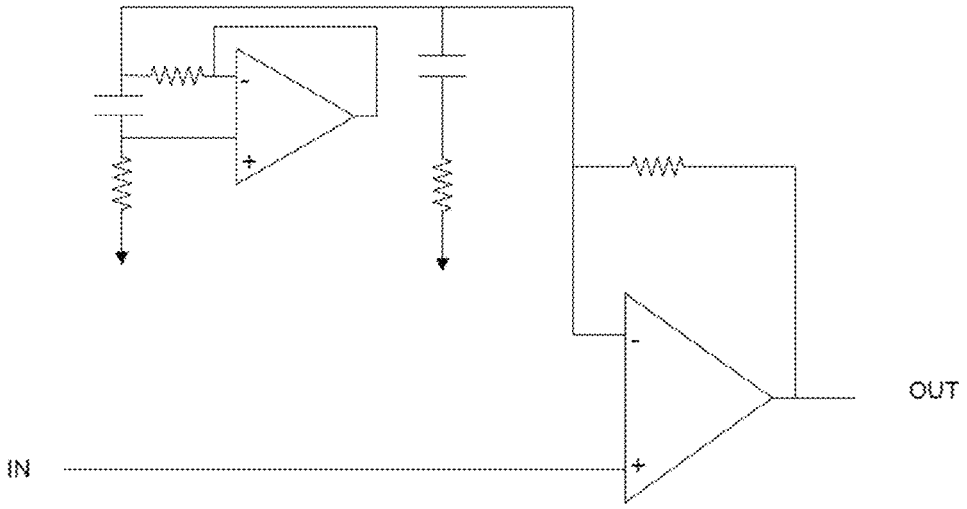
FIG. 11 shows in practical form a simplified circuit to perform the same function as that shown in FIG. 10.

However, because high-value inductors are extremely impractical in the real world, and typically have extremely non-ideal behavior, it is far better to simulate the inductor, again using an analog op-amp, via a circuit commonly known as a "gyrator". An additional advantage is that real-world "gyrator" circuits have a finite series resistance, which is needed anyway to shelve the circuit gain, as described above. Thus, the practical form of the LCR Inverse Transfer Function, substituting a "gyrator" circuit for the inductor and the inductor resistor, becomes the circuit shown in FIG. 11.

Because of the complexity of the circuit, there are some minor component impedance interactions, which are best optimized through the use of SPICE modeling to obtain the proper final f and Q of the LCR Inverse Transfer Function.

2. Acoustical Transfer Function and Inverse Transfer Function

The "Acoustical" RC Transfer Function can be fully described mathematically based on a single parameter: Corner Frequency. The corner frequency is approximately equal to the frequency at which the "effective circumference" of the driver(s) is equal to the wavelength. As a practical example, a driver using a 2" diameter cone has an effective circumference of 6.28", and thus, based on a speed of sound of 13,560 inches per second, would have a corner frequency of approximately 2,160 Hz. However, in a line array utilizing multiple identical drivers, the "effective circumference" is increased by a factor equal to the square root of the total number of drivers, and thus the corner frequency is similarly decreased by a factor equal to the square root of the number of drivers. Thus, as a practical example, in an array which contains thirty-six identical 2" drivers, the corner frequency is reduced to 2160/6, or to 360 Hz.

The practical result of these facts is that varying line array lengths (containing varying numbers of identical drivers) will require minor variations in the RC corner frequency, depending of the line array length (and number of drivers) in each particular installation. Thus, the real-world implementation of the RC Inverse Transfer Function should include a method of varying the corner frequency of the circuit, within a fairly small and well-defined range, to allow optimization of the circuit to arrays of varying length. The RC parameters can be easily obtained from Equation 5 below:

$$2\pi f = \frac{1}{RC} \tag{5}$$

Figure 12:
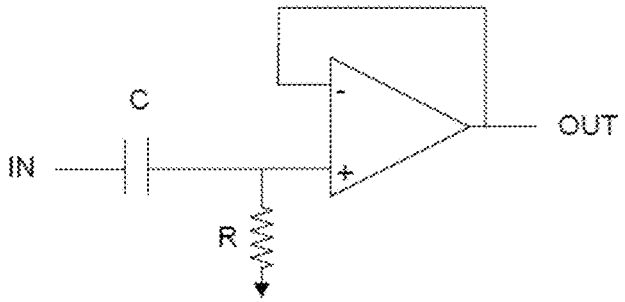
FIG. 12 shows in practical form the RC transfer function of FIG. 6.

A practical form of the RC Transfer Function, utilizing standard analog operational amplifiers (op-amps), is shown in FIG. 12.

Figure 13:
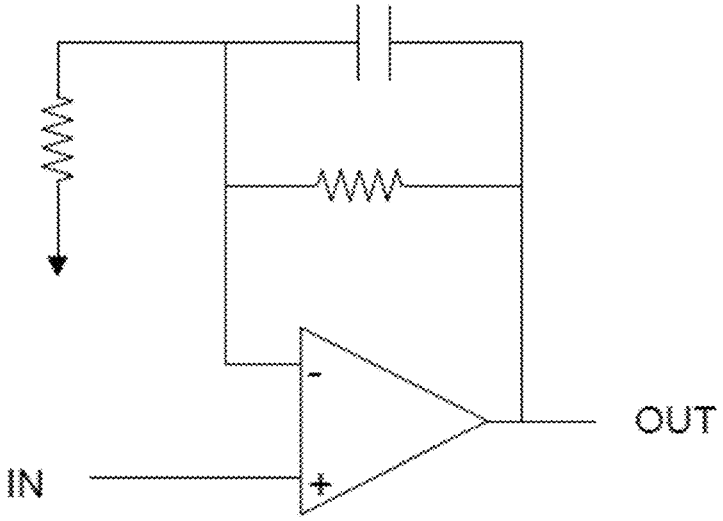
FIG. 13 shows in practical form the inverse transfer function of the RC Transfer function of FIG. 6.

The RC Inverse Transfer Function can then easily be synthesized by placing this basic circuit in the negative feedback loop of an op-amp. Because such a circuit would approach infinite gain at very low frequencies, the gain is deliberately "shelved" at the edge of the audible frequency range. This shelving is accomplished by the addition of a resistor to the C reactive element in the circuit. The basic practical form of the RC Inverse Transfer Function, again utilizing analog op-amps, is shown in FIG. 13.

Figure 14:
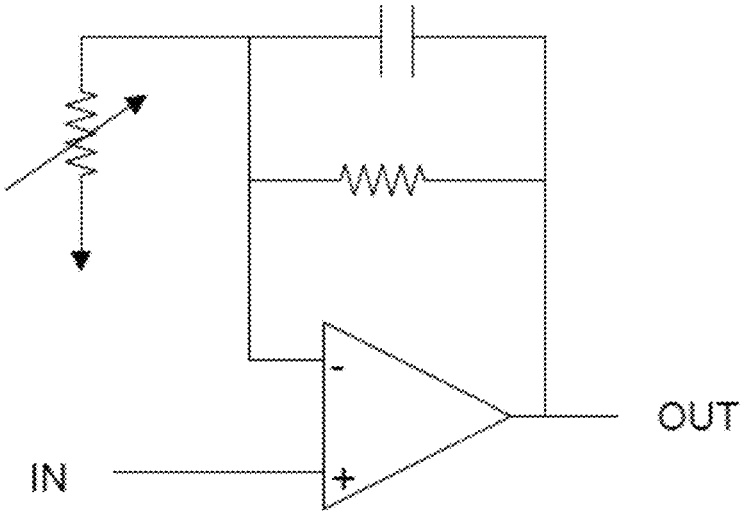
FIG. 14 shows an alternative circuit to that shown in FIG. 13 to provide some variability to vary the corner frequency.

However, due to the need to vary the corner frequency to optimize the circuit for each particular line array length, it is necessary to make one of the resistors in the circuit variable. In the real world, this variable resistor can be achieved through the use of either a potentiometer or a bank of discrete resistors and a selector switch, said switch being either electronic or mechanical. Thus, the practical form of the RC Inverse Transfer Function becomes the circuit shown in FIG. 14.

Because of the complexity of the circuit, there are some minor component impedance interactions, which are best optimized through the use of SPICE modeling to obtain the proper final f of the RC Inverse Transfer Function.

It should be noted that the above op-amp circuit implementations of the Inverse Transfer Functions are only one possible circuit out of a nearly infinite number of possible circuits, and that the Inverse Transfer Functions can be accomplished via many other forms of circuitry in addition to the particular circuit forms shown. The particular form of circuit is not important, as long as the Inverse Transfer Functions obtained through the use of those particular circuits are in fact the necessary Inverses of the loudspeaker's inherent LCR and RC Transfer Functions.

It should further be noted that although the real-world forms of the Inverse Transfer Functions were shown above as implemented with only standard analog op-amps, resistors, and capacitors, the same results could be easily obtained through the use of DSP (Digital Signal Processing), which in some cases may be preferable to analog-based circuits, or through the use of any other suitable type of circuit. As long as the DSP programming is performed in such a way as to simulate the LCR and RC Inverse Transfer Functions correctly in amplitude and phase, the results obtained would be essentially identical to the shown implementation of the analog circuits.

Figure 15:
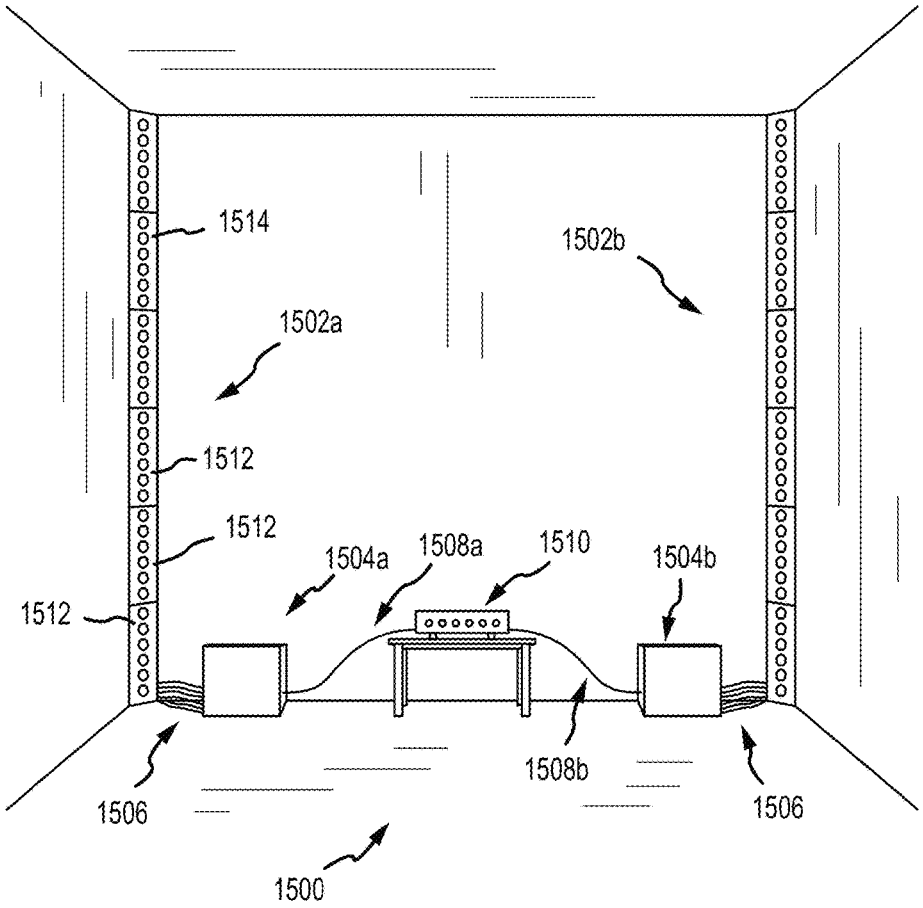
FIG. 15 shows a physical arrangement of the loudspeaker system.

Various physical arrangements for the loudspeaker reference design disclosed herein will now be discussed. As shown in FIG. 15, one specific example of a practical embodiment based on these teachings includes a loudspeaker system 1500 that includes a pair of loudspeaker stacks 1502*a* and 1502*b*, one in each of two adjacent corners of a room, which each include a plurality of loudspeaker drivers 1514 in a vertical column. Each stack 1502*a* and 1502*b* has a control electronics enclosure 1504*a* and 1504*b* associated therewith. The pair of control electronics enclosures 1504*a* and 1504*b* provide electrical signals to the loudspeaker stacks 1502*a* and 1502*b* via a plurality of cables 1506 and they each receive electrical signals via cables 1508*a* and 1508*b* from audio amplifier 1510. The control electronics enclosures 1504*a* and 1504*b* may include circuitry such as that described above for applying the above-described transfer functions. In one embodiment, there may be one cable 1506 from the control electronics enclosures 1504*a* and 1504*b* for each of a plurality of separate loudspeaker enclosures 1512 in each loudspeaker stack 1502*a* and 1502*b*.

Figure 16:
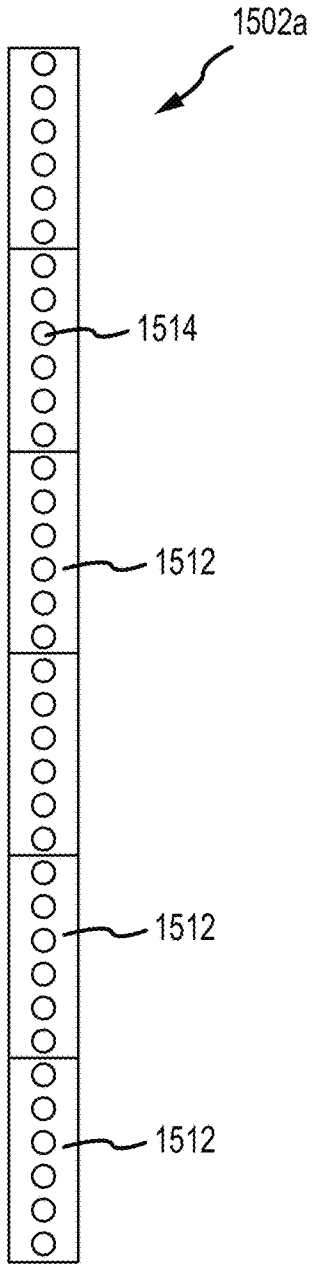
FIG. 16 shows one of the stacks of loudspeaker drivers of FIG. 15.
Figure 17:
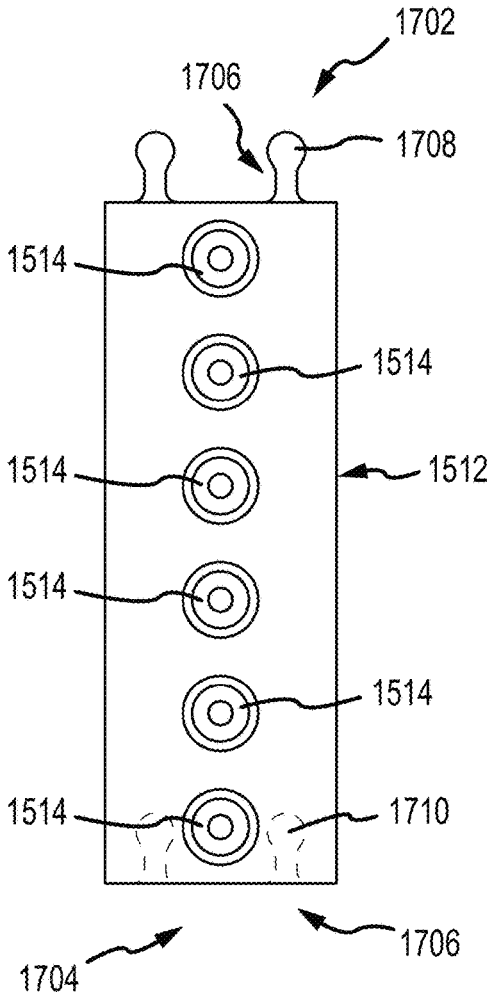
FIG. 17 shows a single enclosure from the stack of FIG. 16.

As is shown in FIGS. 16 and 17, in one example, each separate enclosure 1512 in one of the loudspeaker stacks 1502*a* and 1502*b* may include six identical loudspeaker drivers 1514. In one example, each driver 1514 may be a two-inch driver, such as a Peerless by Tymphany NE65 W-04. Further, in one example shown in FIG. 18, each driver 1514 may have a nominal impedance of 4 ohms and may be wired within a given enclosure 1512 with three such drivers 1514 in series (providing an impedance of 12 ohms). Two sets of three such series-connected drivers 1514 could be wired in parallel so that the combined impedance of the drivers 1514 in a given enclosure is 6 ohms. As mentioned previously, there may be one speaker cable 1506 that is used to supply the electrical signal to a first enclosure 1512, and a separate, additional such cable 1506 to supply the electrical signal to each other enclosure 1512.

Figure 18:
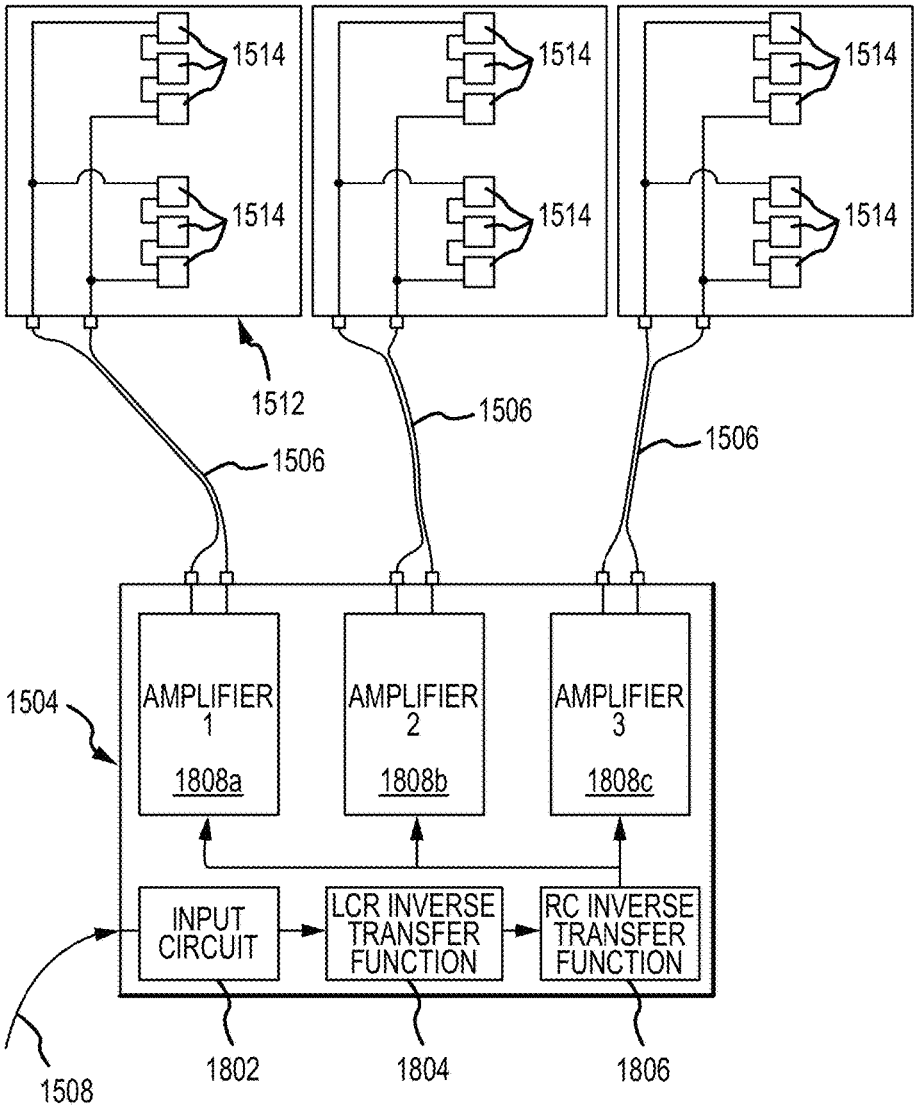
FIG. 18 shows the electrical componentry and interconnection of the control electronics enclosure and a plurality of loudspeaker enclosures.

FIG. 18 also shows further details about the electronic components in the control electronics enclosure 1504. An electrical audio signal may be provided to the control electronics enclosure 1504 on cable 1508 from audio preamplifier 1510. That signal is provided to an input circuit 1802 which may perform the functions of input buffering, level control, ND conversion, D/A conversion, wireless signal reception and conversion to a wired signal (these are merely examples of functions that could be performed). A signal from the input circuit 1802 is provided to a circuit 1804 that accomplishes the LCR Transfer Function which then provides a signal to a circuit 1806 that accomplishes the RC Transfer Function. The output of that latter circuit 1806 is then provided to a plurality of separate amplifiers 1802*a*, 1802*b*, 1802*c*, which then each provide a modified electrical audio signal to one of the enclosures 1512.

As can also be seen in FIG. 17, each of a top surface 1702 and a bottom surface 1704 of each of the enclosures 1512 may include mating surfaces 1706 thereon for engagement with the corresponding mating surfaces 1706 of an adjacent enclosure 1512. In one example, these mating surfaces 1706 may include a male surface 1708 on the top surface 1702 of the enclosure 1512 and a female surface 1710 on the bottom surface of the enclosure 1512. The nature of the engagement between two adjacent enclosures may prevent relative movement between the adjacent enclosures in at least two different orthogonal directions. It should be understood that other types of mating surfaces could be used for mating engagement with an adjacent enclosure 1512.

As viewed from the top of each enclosure 1512, it could have a generally triangular profile, so as to fit nicely into a corner. Alternatively, the enclosure could have any other suitable shape that allows it to be placed into a corner of a room.

Figure 19:
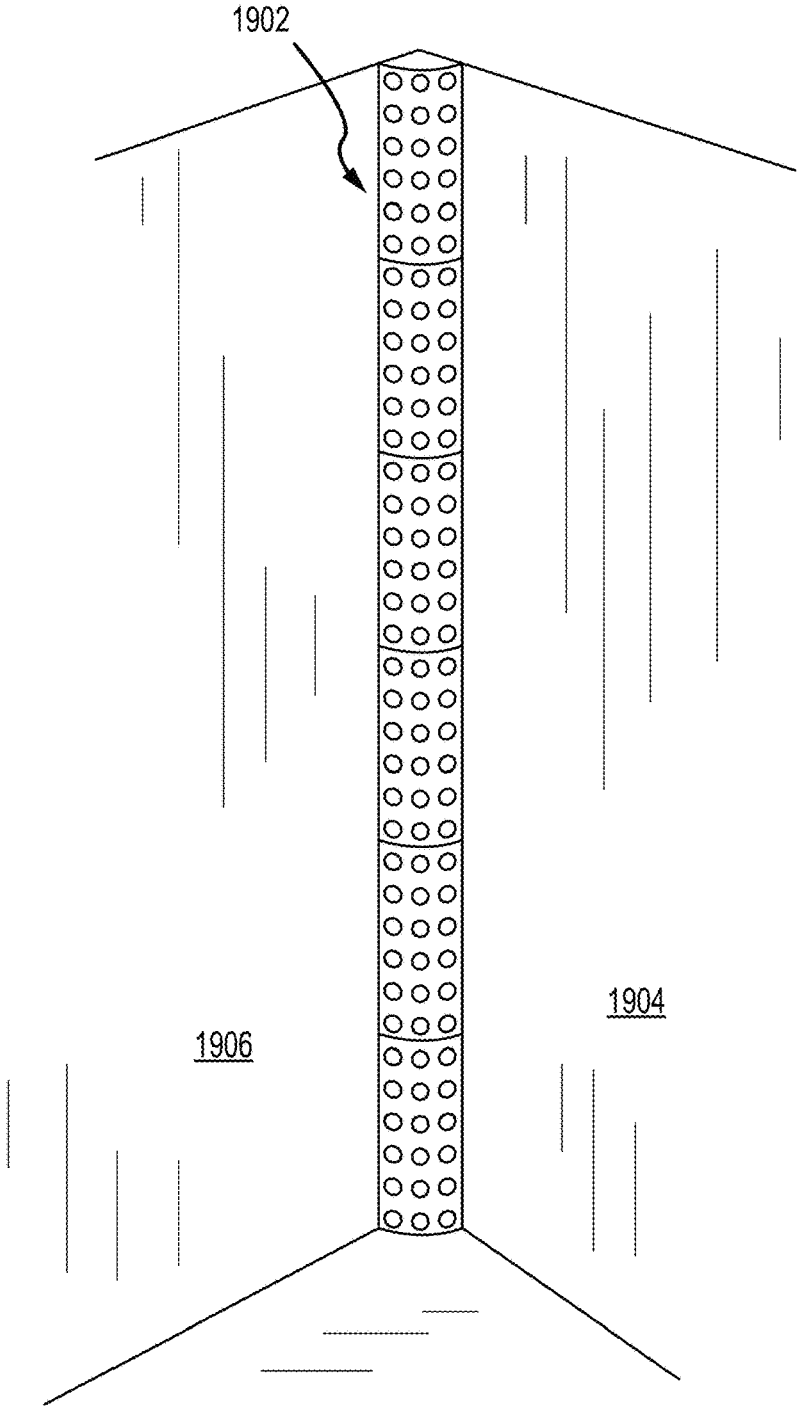
FIG. 19 shows an alternate arrangement of a stack of loudspeaker drivers with three columns of loudspeaker drivers.
Figure 20:
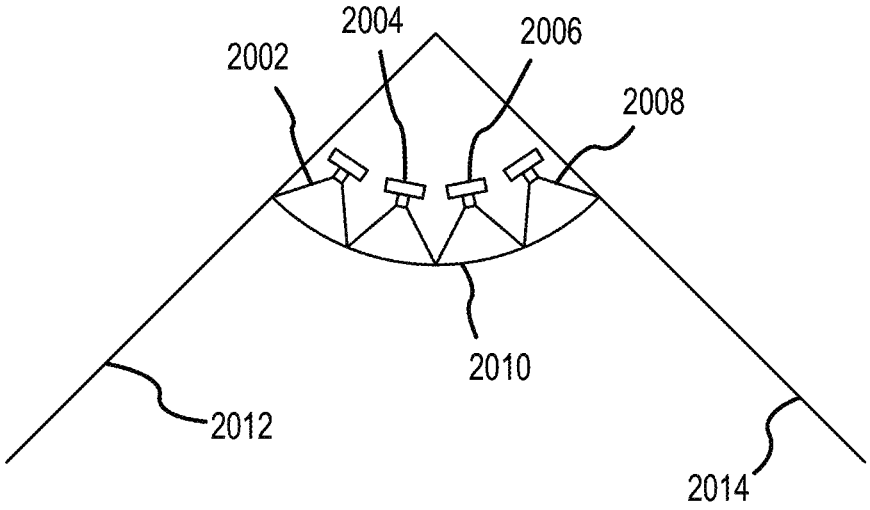
FIG. 20 shows an alternate arrangement with four columns of loudspeaker drivers.

It should be understood that the above is merely a description of a possible illustrative embodiment, and that this example is not intended to limit the scope of the invention. By way of non-limiting example, the drivers could be wired together with any number of drivers in series or in parallel, the drivers could be of a different size or shape, the number of drivers per enclosure could be any suitable number including one, the number of enclosures could be any suitable number including one, the location of the elongated stack could be at the intersection of two other room boundaries (e.g., such as between a vertical wall and the ceiling or between a vertical wall and the floor), the enclosures could be of any suitable shape, the height of the stack and the room could be any other suitable length, and the drivers need not all be vertically aligned as they are in this example. For example, as is shown in FIGS. 19 and 20, each stack of loudspeakers could include more than one column of loudspeaker drivers. For example, rather than the single column of vertically-aligned drivers in the arrangement shown in FIGS. 15-17, there could be a plurality of columns of vertically-aligned drivers mounted on a curved or angled surface. This is shown in FIG. 19, with 3 columns of identical drivers in a stack 1902 positioned in a corner between two adjacent walls 1904, 1906 of a room. Alternatively, as shown in FIG. 20, this could include 4 drivers 2002, 2004, 2006, 2008 spaced apart along a curved arc 2010 at the same height above the floor, which would create 4 columns of drivers. Any suitable number of columns of drivers could be used. Such an arrangement could be placed in a corner between two adjacent walls 2012, 2014 of a room.

It should be understood that the dimensions of a room in which the loudspeaker system disclosed herein is installed should not be considered to be limiting to the scope of the invention described herein. The system could suitably operate in a room with 8-foot ceilings (96 inches), 12-foot ceilings (144 inches), or any other suitable height. The system may extend vertically in a corner between two adjacent walls in a room for the entirety of the height between the floor and the ceiling, for only approximately 75% or more of the height, or for any other suitable length. In one embodiment, a system in an 8-foot room may include 6 enclosures, which each have 6 drivers, for a total of 36 drivers. In another embodiment, a system in a 12-foot room may include 9 enclosures, which each have 6 drivers, for a total of 54 drivers. In another embodiment, there may be any number greater than or equal to 10 drivers, greater than or equal to 20 drivers, or any other suitable number.

The following discussion refers to how to compute the additional system output capability (in dB) when going from a single-column array to a 4-column or 10-column array.

When additional Sound Pressure Level (SPL) is desirable, for use in larger rooms and/or higher output levels than achievable with a single-column array, it is possible to create larger arrays by using multiple columns of drivers in close proximity. In order to preserve a close approximation of a quarter-cylindrical acoustical wavefront, the multiple-column corner line arrays can be shaped such that the drivers in the corner line array are mounted in a quarter-cylindrical geometry (see FIG. 20 for an example of the cross-sectional shape of a four-column corner line array).

In order to compute the additional SPL capability of a multiple-column array, two things must be considered. Firstly, it is known that with every doubling of the number of drivers working in acoustical parallel (provided that the total power input is doubled also, meaning that each driver is now provided with the same power as the original single driver was provided with), the acoustical output will increase by 6 dB. For example, going from a single driver with 10 W input power, to four identical drivers with 40 W total input power (keeping the same 10 W input power per driver), will increase available SPL capability by 12 dB. This fact can be expressed by the equation $d1=20*\log(n)$, where d1 is the change in SPL capability due to increased driver numbers (measured in dB), and n is the total number of drivers in acoustical parallel, when "Watts Per Driver" is held constant.

Secondly, in the techniques disclosed herein, the fundamental limitation in SPL capability (when reproducing music or sound with wide-band spectral energy content, such as pink noise) occurs due to power-amplifier output limitations at low frequencies, due to the increased gain (boost) of low-frequency signals imposed by both the LCR Inverse Transfer Function and the RC Inverse Transfer Function. It has already been discussed that the RC Inverse Transfer Function's corner frequency is inversely proportional to the square root of the total number of drivers working in acoustical parallel. Thus, given that the RC Inverse Transfer Function at low frequencies is in the form of a first-order (6 dB per octave) upward slope, quadrupling the number of drivers will result in a halving of the corner frequency, and thus will result in a reduction in requisite low-frequency boost of 6 dB also. The resulting 6 dB reduction in requisite power-amplifier output power at low frequencies translates into an effective wideband SPL capability increase (from the total system) of essentially 6 dB. This fact can be expressed by the equation d2=10*log(n), where d2 is the increase in system SPL capability, on sound with wide-band spectral energy content, due to reduction of low-frequency boost (measured in dB), and n is the total number of drivers.

Thus, the total effective increase in system SPL capability, measured in dB (for sound with wide-band spectral energy content), due to increasing the array size (provided that input power, in Watts Per Driver, is held constant), can be expressed as D=d1+d2, or D=30*log(n). Thus, for example, by quadrupling the total number of drivers, the system will achieve approximately an 18 dB increase in maximum available SPL on source material with wide-band spectral content. Similarly, increasing the number of drivers tenfold will achieve approximately a 30 dB increase in maximum available SPL on source material with wide-band spectral content.

It has also been discovered that it may be desirable to have a (concave) curved surface on either side of the driver column, with the concave surface being designed to curve smoothly from the driver plane to the wall plane on either side of the column, where it becomes essentially tangent to the wall plane. This forms an acoustical "smooth path without reflectivity" for the sound waves to follow until they are tangent to the wall planes, and prevents what would otherwise be a large and potentially problematic acoustic reflection off the adjacent planar wall surfaces.

Below are some basic signal and power flow configurations. In certain of the remaining figures, S means signal, Proc means processor (containing input means of any kind, plus LCR and RC Inverse Transfer Functions, plus driver circuitry for the Amplifiers), AC is AC power, DC is DC power, Amp is an amplifier, PS means Power Supply (for the Amplifier). Then there are many variations as to physical configuration (where the various pieces are located). One of the themes that runs heavily through these examples is the idea of a "carrier", a piece which is mounted to the wall or stands alone, which then is able to accept one or more "speaker modules" which are designed to attach to the "carrier" via a semi-permanent (removable) attachment system. While many of the following configurations are shown utilizing a carrier system, it is understood that all potential general configurations, both shown and unshown, can be achieved without the use of a carrier system. The carrier system may make manufacturing and installation easier, for several reasons:

1. The carriers can be mounted ahead of time, allowing easy installation (due to light weight and easy access to mounting screw holes, or use double-sided tape, etc), easy alignment, and no danger of damaging the speakers with tools.

2. The entire concept allows the manufacturer to make only one type of speaker module in their entire production line, and then make dozens of different carriers, all of which accept the same speaker modules. That speaker module will be of reasonable size and weight, making production, inventory, shipping, installation and replacement very easy. The customer then orders the appropriate type of carriers for their intended installation, and a large number of identical speaker modules. This makes production very easy (and cheap), relative to the alternative.

3. It remains to be seen whether the processor and/or amplifiers and/or power supplies should be contained within the speaker modules, or within the carriers. There are advantages both ways.

The "base module" is a small piece or box that goes under the main column (stack) and contains (most likely) the inputs, the processor, on/off switching, etc.

Another concept includes carrying the signal and AC or DC from the base module up through the stack via a series of electrical contacts at the tops and bottoms of the modules.

Figure 21:
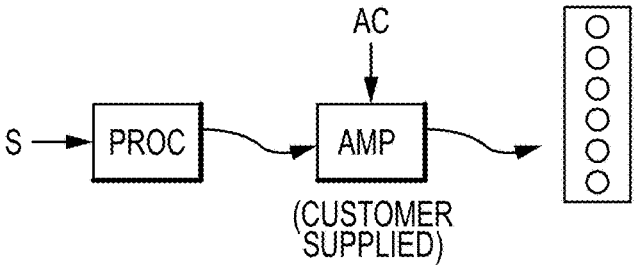
FIGS. 21-26 show various configuration variations.

FIGS. 21-44 show some examples of various arrangements for the loudspeaker systems disclosed herein. FIG. 21 shows an arrangement where an audio signal S is fed to a processor that at least includes the two inverse transfer functions disclosed herein. The output from the processor is fed to a loudspeaker array such as is disclosed herein.

Figure 22:
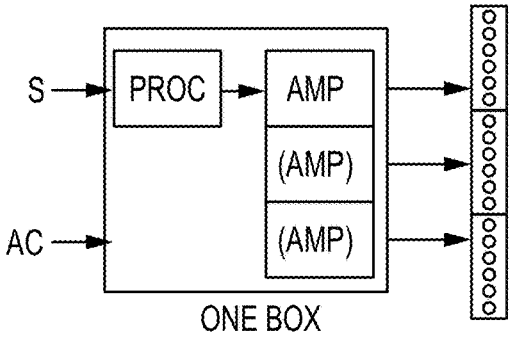

FIG. 22 shows an arrangement where a single box contains the processor and separate amplifiers (e.g., one for each loudspeaker enclosure). The box is fed the signal S and A/C power. The outputs of the amplifiers are provided to the enclosures.

Figure 23:
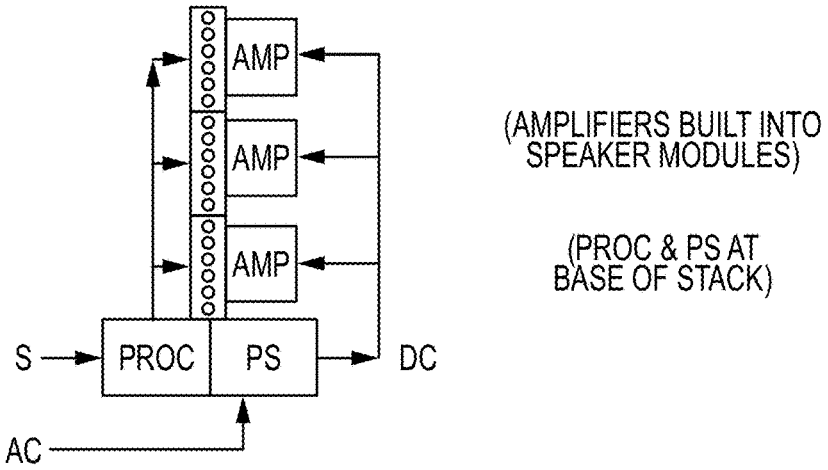

FIG. 23 shows the amplifiers built into each loudspeaker enclosure or module. The processor and power supply may be located in a single enclosure at the bottom of the stack of enclosures, and the processed signal and DC power may be fed to each enclosure.

Figure 24:
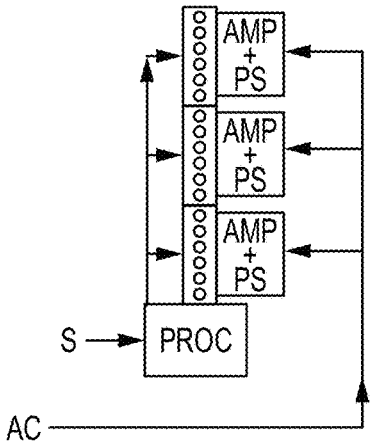

FIG. 24 shows a power supply and an amplifier built into each enclosure in the stack and a processor at the base of the stack which receives the audio signal S and feeds processed signals to each powered speaker enclosure. In addition, the stack may contain a means for distributing AC power to each enclosure via a series of electrical connections between each carrier or speaker module.

Figure 25:
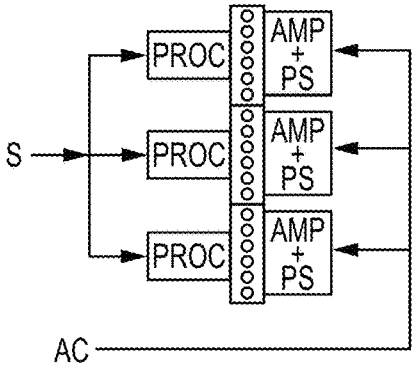

FIG. 25 shows the speaker enclosures being completely self-contained, so that they each include a processor, power supply, and amplifier, and the audio signal S and NC power are fed to each enclosure.

Figure 26:
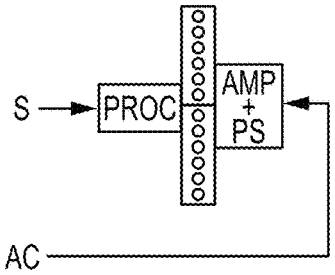

FIG. 26 shows a single box that includes a processor, power supply, amplifier, and a plurality of drivers. The box is fed the audio signal S and NC power.

Figure 27:
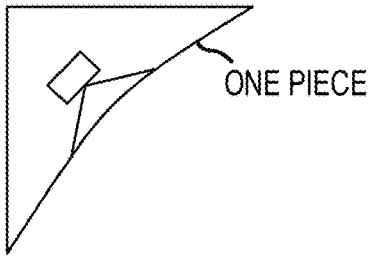
FIGS. 27-31 and 32A-35B show various column variations.

FIGS. 27-35 shows various column variations. FIG. 27 shows a shape as described above, to form an acoustical "smooth path without reflectivity" for the sound waves to follow until they are tangent to the wall planes.

Figure 28:
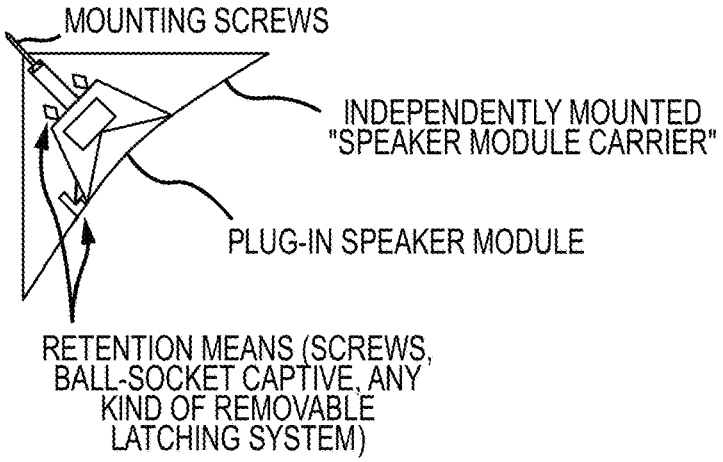

FIG. 28 shows an independently mounted speaker module carrier with one or more plug-in speaker modules. The modules may be retained in the carrier with any suitable retention device such as screws, ball/socket, latches, or even friction.

Figure 29:
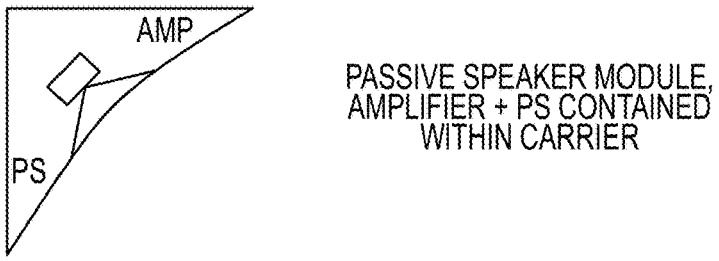

FIG. 29 shows a passive speaker module, power supply, and amplifier all contained within the carrier.

Figure 30:
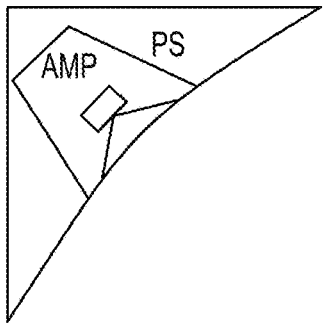

FIG. 30 shows a powered speaker module with an amplifier therein and a power supply contained in the carrier.

Figure 31:
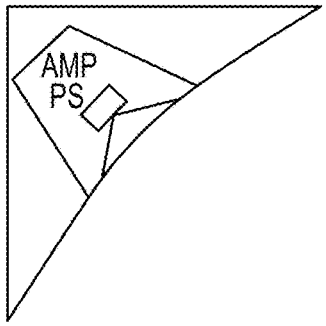

FIG. 31 shows a power supply and amplifier contained within the speaker module.

Figure 32A:
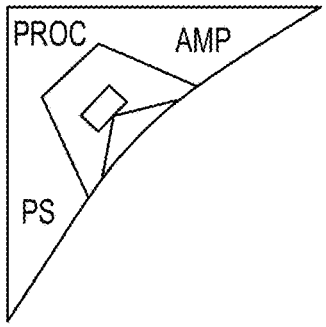
Figure 32B:
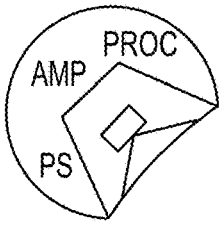

FIG. 32A shows a processor, power supply, and amplifier, all within the carrier, and a passive speaker module, while FIG. 32B shows the same arrangement in a desktop variation that is not necessarily placed in a corner of a room or even against a wall.

Figure 33A:
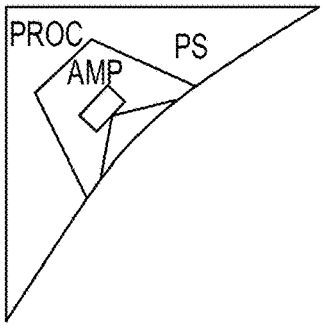
Figure 33B:
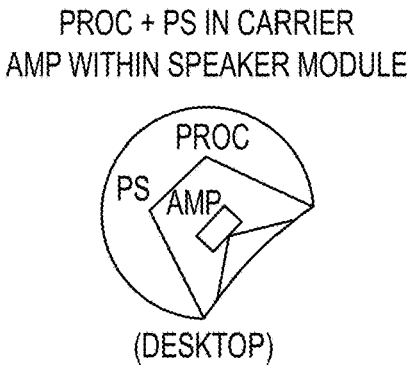

FIG. 33A shows a processor and power supply within the carrier, and a speaker module with an amplifier therein, while FIG. 33B shows the same arrangement in a desktop variation that is not necessarily placed in a corner of a room or even against a wall.

Figure 34A:
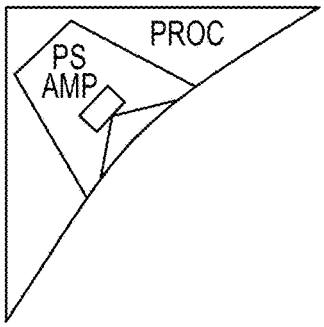
Figure 34B:
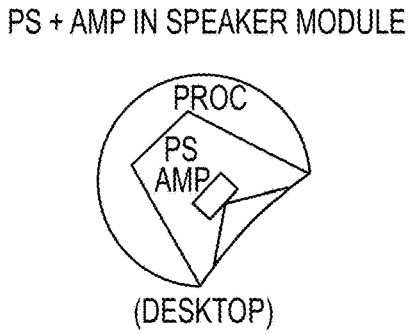

34A shows a processor within the carrier, and a speaker module with a power supply and amplifier therein, while FIG. 34B shows the same arrangement in a desktop variation that is not necessarily placed in a corner of a room or even against a wall.

Figure 35A:
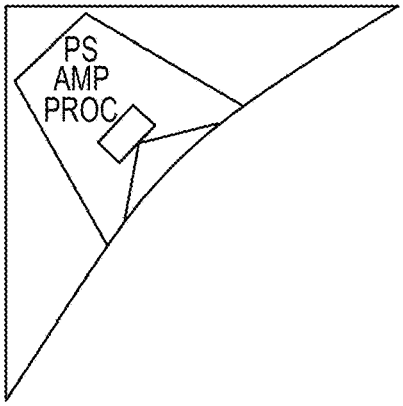
Figure 35B:
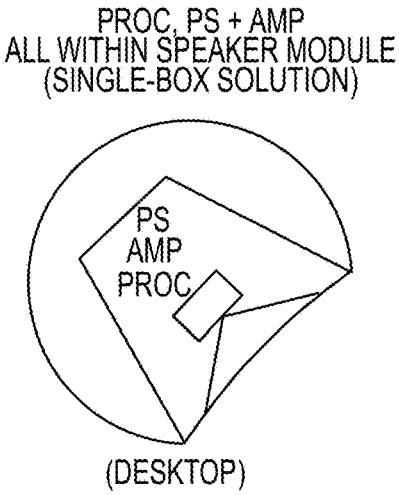

35A shows a carrier, and a speaker module with a processor, power supply, and amplifier therein, while FIG. 35B shows the same arrangement in a desktop variation that is not necessarily placed in a corner of a room or even against a wall.

Figure 36:
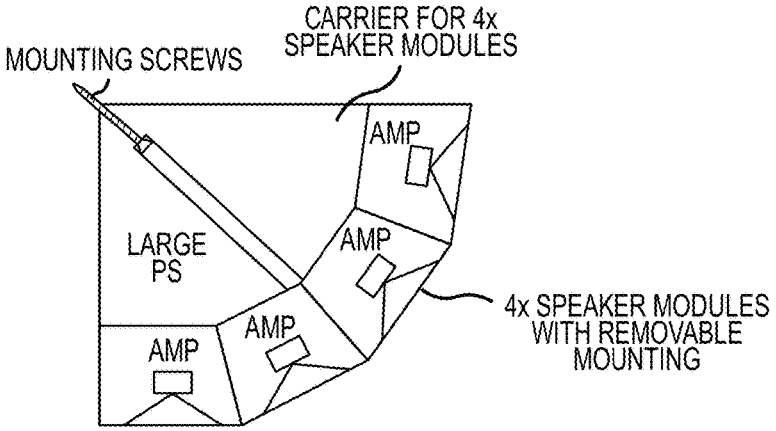
FIGS. 36-38 show various large array variations.
Figure 37:
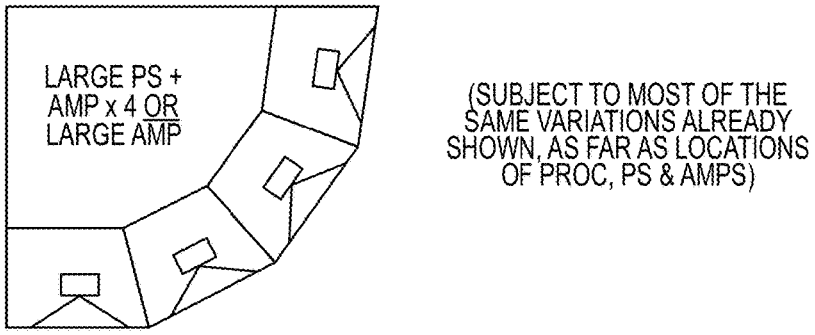
Figure 38:
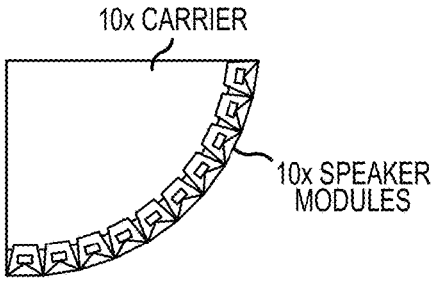

FIGS. 36-38 show larger arrays. FIG. 36 shows a carrier for 4 columns of speaker modules. A large power supply may be contained in the carrier, and each speaker module may have an amplifier therein.

FIG. 37 also shows a similar arrangement as FIG. 36, but with the possibility of 4 amplifiers or one large amplifier in the carrier. Any of the above-discussed variations could be applied to this arrangement or to any other arrangement.

FIG. 38 shows a similar arrangement, but with 10 speaker modules.

Figure 39:
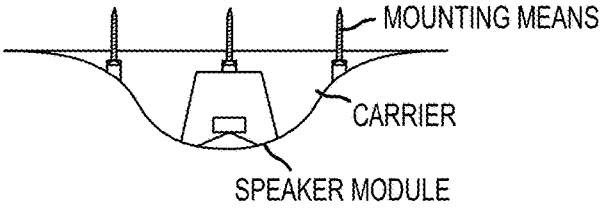
FIGS. 39-41 show various flat-wall variations.
Figure 40:
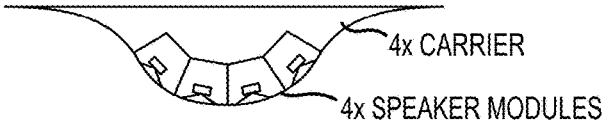
Figure 41:
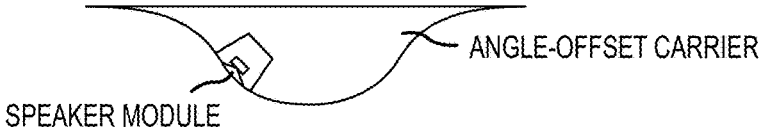

FIGS. 39-41 show flat-wall variations, as opposed to arrangements for corners of rooms. FIG. 39 shows a carrier that provides the previously-discussed smooth path without reflectivity. The carrier may be mounted to the wall in a suitable fashion, such as with screws. The speaker module may be retained within the carrier.

FIG. 40 shows a similar arrangement where the carrier retains 4 speaker modules.

FIG. 41 shows a similar arrangement, but with the speaker module retained within the carrier in an offset position.

Figure 42A:
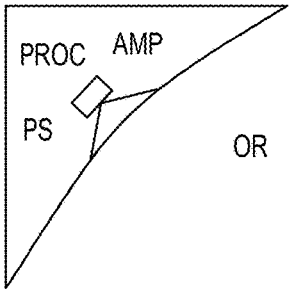
FIGS. 42A-42C show various all-in-one variations.
Figure 42B:
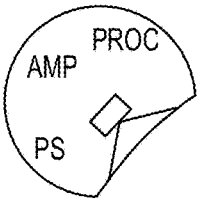
Figure 42C:
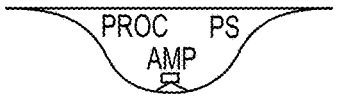

FIGS. 42A-42C show all-in-one variations. FIG. 42A shows a processor, power supply, amplifier, and loudspeaker driver all contained together. FIG. 42B shows a similar arrangement (with a processor, power supply, amplifier, and loudspeaker driver all contained together) in a desktop variation. FIG. 42C shows the same arrangement (with a processor, power supply, amplifier, and loudspeaker driver all contained together) in a flat wall variation.

Figure 43:
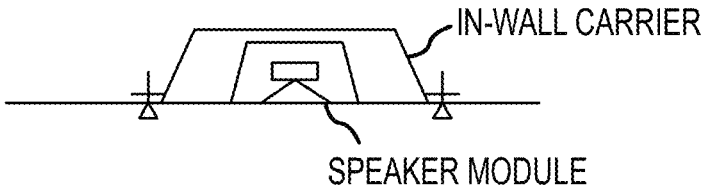
FIGS. 43 and 44 show various in-wall variations.
Figure 44:
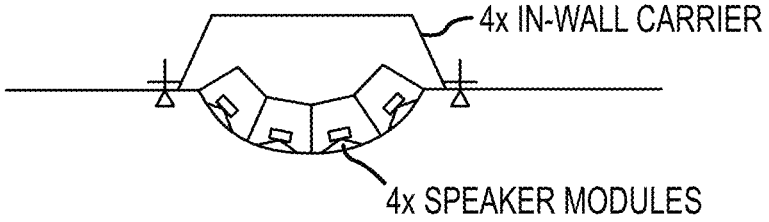

FIGS. 43 and 44 show more in-wall variations. FIG. 43 shows an in-wall carrier that contains a speaker module and may or may not contain some combination of a processor, power supply, and amplifier. FIG. 44 shows the same arrangement with 4 speaker modules.

It should be understood that any combination or permutation of the various teachings herein could be made to achieve the objectives described herein.

While the foregoing has illustrated and described several embodiments in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only the preferred embodiment and variants thereof have been shown and described and that all changes and modifications that come within the spirit of the disclosure are desired to be protected.

I claim:

1. An electrodynamic line-source loudspeaker system, comprising:

an elongated array of electrodynamic drivers that receive an electrical signal and convert the electrical energy in the electrical signal into movement of a diaphragm, wherein the elongated array has a long axis and a short axis that is orthogonal to the long axis, the long axis having a significantly greater length than the short axis, wherein each driver in the array is of the same size, wherein the array has a composite electromechanical bandpass transfer function and the array has a composite acoustical impedance high-pass transfer function; wherein:

the composite electromechanical bandpass transfer function describes motion of the diaphragm as a function of the electrical signal; and the composite acoustical impedance high-pass transfer function represents an emitted sound as a function of the motion of the diaphragm; and an audio signal converter, wherein the audio signal converter receives an electrical audio signal representative of sound waves to be reproduced by the loudspeaker system and the audio signal converter converts the electrical audio signal to a modified electrical audio signal by applying an inverse of the electromechanical bandpass transfer function and applying an inverse of the acoustical impedance high-pass transfer function to the electrical audio signal;

wherein the modified electrical audio signal is the electrical signal received by the elongated array of electrodynamic drivers.

2. A loudspeaker system as defined in claim 1, wherein each of the drivers in the array is operated in acoustic parallel such that the acoustic output of the drivers is additive.

3. A loudspeaker system as defined in claim 1, wherein each driver has a first mechanical diaphragm resonance above 10 kHz.

4. A loudspeaker system as defined in claim 1, wherein each driver has a first mechanical diaphragm resonance above 15 kHz.

5. A loudspeaker system as defined in claim 1, wherein the array is configured for placement in a corner of a room with the long axis oriented vertically.

6. A loudspeaker system as defined in claim 5, wherein the array extends for at least 75% of a distance between a floor and a ceiling of the room.

7. A loudspeaker system as defined in claim 5, further including a second such audio signal converter and a second such elongated array of electrodynamic drivers, and wherein the second array is configured for placement in a second corner of the room with the long axis oriented vertically.

8. A loudspeaker system as defined in claim 1, wherein the array of drivers is mounted in a single enclosure.

9. A loudspeaker system as defined in claim 1, wherein the array of drivers is mounted in a plurality of enclosures.

10. A loudspeaker system as defined in claim 9, wherein each enclosure includes a plurality of drivers.

11. A loudspeaker system as defined in claim 9, wherein there is an audio signal converter for each enclosure.

12. A loudspeaker system as defined in claim 10, wherein a portion of the drivers in each enclosure are electrically connected together in series.

13. A loudspeaker system as defined in claim 11, wherein two or more of the drivers in each enclosure are electrically connected together in series to form a first set of drivers in each enclosure, two or more other drivers in each enclosure are electrically connected together in series to form a second set of drivers in each enclosure, and the two sets of drivers in each enclosure are electrically connected together in parallel.

14. A loudspeaker system as defined in claim 10, wherein two or more drivers in each enclosure are electrically connected together in parallel.

15. A loudspeaker system as defined in claim 9, wherein each enclosure has mating surfaces defined on a top surface thereof and mating surfaces defined on a bottom surface thereof, the mating surfaces on the top surface of one of the plurality of enclosures being engageable with the mating surfaces on the bottom surface of another one of the plurality of enclosures;

wherein the plurality of enclosures can be engaged with each other to form an elongated stack of enclosures to achieve the elongated array of electrodynamic drivers.

16. A loudspeaker system as defined in claim 15, wherein at least three such enclosures are engaged with each other to form the elongated stack.

17. A loudspeaker system as defined in claim 1, wherein the elongated array of electrodynamic drivers includes only a single elongated electrodynamic driver.

18. A loudspeaker system as defined in claim 1, wherein the elongated array of electrodynamic drivers includes at least 10 electrodynamic drivers of the same type and size.

19. A loudspeaker system as defined in claim 1, wherein the elongated array of electrodynamic drivers includes a plurality of circularly-shaped electrodynamic drivers of the same type and size.

20. An electrodynamic line-source loudspeaker system, comprising:

an elongated array of electrodynamic drivers that receive an electrical signal and convert the electrical energy in the electrical signal into movement of a diaphragm, wherein the elongated array has a long axis and a short axis that is orthogonal to the long axis, the long axis having a significantly greater length than the short axis, wherein each driver in the array is of the same size, wherein the array has a composite electromechanical bandpass transfer function and the array has a composite acoustical impedance high-pass transfer function, wherein:

the composite electromechanical bandpass transfer function describes motion of the diaphragm as a function of the electrical signal; and the composite acoustical impedance high-pass transfer function represents an emitted sound as a function of the motion of the diaphragm;

wherein each driver is a circularly-shaped electrodynamic drivers of the same type and size and each driver has a first mechanical diaphragm resonance above 10 kHz, wherein the array includes at least 10 such drivers; and an audio signal converter, wherein the audio signal converter receives an electrical audio signal representative of sound waves to be reproduced by the loudspeaker system and the audio signal converter converts the electrical audio signal to a modified electrical audio signal by applying an inverse of the electromechanical bandpass transfer function and applying an inverse of the acoustical impedance high-pass transfer function to the electrical audio signal, wherein the modified electrical audio signal is the electrical signal received by the array of electrodynamic drivers;

wherein the array is configured for placement in a corner of a room with the long axis oriented vertically and the array extends for at least 75% of a distance between a floor and a ceiling of the room.

* * * * *